US007284512B2

(12) United States Patent
Hirano

(10) Patent No.: US 7,284,512 B2
(45) Date of Patent: Oct. 23, 2007

(54) COMPRESSION RATIO VARIABLE DEVICE OF INTERNAL COMBUSTION ENGINE

(75) Inventor: Makoto Hirano, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 42 days.

(21) Appl. No.: 10/523,692

(22) PCT Filed: Aug. 4, 2003

(86) PCT No.: PCT/JP03/09856

§ 371 (c)(1),
(2), (4) Date: Oct. 14, 2005

(87) PCT Pub. No.: WO2004/013480

PCT Pub. Date: Feb. 12, 2004

(65) Prior Publication Data

US 2006/0102115 A1 May 18, 2006

(30) Foreign Application Priority Data

Aug. 5, 2002 (JP) ..... 2002-227790

(51) Int. Cl.
*F02D 15/02* (2006.01)

(52) U.S. Cl. ..... 123/48 B; 123/48 R

(58) Field of Classification Search ..... 123/48 B, 123/48 R

See application file for complete search history.

(56) References Cited

U.S. PATENT DOCUMENTS

| | | | | |
|---|---|---|---|---|
| 3,704,695 | A * | 12/1972 | Cronstedt | 123/78 B |
| 4,809,650 | A * | 3/1989 | Arai et al. | 123/78 B |
| 4,864,977 | A * | 9/1989 | Hasegawa | 123/48 B |
| 4,934,347 | A * | 6/1990 | Suga et al. | 123/78 B |
| 6,289,857 | B1 * | 9/2001 | Boggs | 123/78 E |
| 6,966,282 | B2 * | 11/2005 | Hirano | 123/48 B |
| 2004/0231619 | A1 * | 11/2004 | Hirano | 123/48 B |
| 2006/0090715 | A1 * | 5/2006 | Kondo et al. | 123/48 B |

FOREIGN PATENT DOCUMENTS

| | | | |
|---|---|---|---|
| JP | 63-131839 | A | 6/1988 |
| JP | 63-143342 | A | 6/1988 |
| JP | 6-212993 | A | 8/1994 |
| JP | 7-113330 | A | 12/1995 |
| JP | 11-117779 | A | 4/1999 |
| WO | WO-02/103178 | A1 | 12/2002 |

* cited by examiner

*Primary Examiner*—Willis R. Wolfe
*Assistant Examiner*—Jason Benton
(74) *Attorney, Agent, or Firm*—Birch, Stewart, Kolasch & Birch, LLP

(57) ABSTRACT

An internal combustion engine variable compression ratio system includes a piston inner, a piston outer that, while being fitted around the outer periphery of the piston inner, so it slides only in the axial direction, is capable of moving among low (L), high (H), and medium (M) compression ratio positions, and two sets of raising means disposed in line in the axial direction between the piston inner and outer. Each set of raising means includes a movable raising member, which can pivot individually between a non-raised position (A) and a raised position (B) around the axis of the piston inner and outer. It is thus possible to provide an internal combustion engine variable compression ratio system that enables the compression ratio to be appropriately switched between at least three stages, that is, between low, medium and high compression ratios, without rotating the piston outer.

20 Claims, 22 Drawing Sheets

LOW COMPRESSION RATIO STATE

LOW COMPRESSION RATIO STATE

LOW COMPRESSION RATIO STATE

LOW COMPRESSION RATIO STATE

LOW COMPRESSION RATIO STATE

LOW COMPRESSION RATIO STATE

LOW COMPRESSION RATIO STATE

MEDIUM COMPRESSION RATIO STATE

MEDIUM COMPRESSION RATIO STATE

MEDIUM COMPRESSION RATIO STATE

MEDIUM COMPRESSION RATIO STATE

HIGH COMPRESSION RATIO STATE

HIGH COMPRESSION RATIO STATE

HIGH COMPRESSION RATIO STATE

HIGH COMPRESSION RATIO STATE

LOW COMPRESSION RATIO STATE

MEDIUM COMPRESSION RATIO STATE

HIGH COMPRESSION RATIO STATE

LOW COMPRESSION RATIO

MEDIUM COMPRESSION RATIO

HIGH COMPRESSION RATIO
R2
R1
132
142
141
131
152b
152a
152
151b
151a
151

LOW COMPRESSION RATIO

MEDIUM COMPRESSION RATIO

HIGH COMPRESSION RATIO
R2
R1
132
142
58b
59b
58a
59a
141
131
152b
152a
152
151b
151a
151

COMPRESSION RATIO VARIABLE DEVICE OF INTERNAL COMBUSTION ENGINE

CROSS-REFERENCE TO RELATED APPLICATION

The present application claims priority under 35 U.S.C. §119 to Japanese Patent Application No. 2002-227790, filed Aug. 5, 2002, the entire contents of which are hereby incorporated by reference.

BACKGROUND OF THE INVENTION

1. Field of the Invention

The present invention relates to an internal combustion engine variable compression ratio system and, in particular, to an improvement thereof in which a piston includes a piston inner and a piston outer, the piston inner being connected to a connecting rod via a piston pin, and the piston outer, while being connected to the piston inner and having an outer end face thereof facing a combustion chamber, being capable of moving between a low compression ratio position close to the piston inner and a high compression ratio position close to the combustion chamber, the compression ratio of the engine being decreased by moving the piston outer to the low compression ratio position, and the compression ratio being increased by moving the piston outer to the high compression ratio position.

2. Background Art

Conventionally, with regard to such an internal combustion engine variable compression ratio system, there is a known system (1) in which a piston outer is screwed around the outer periphery of a piston inner, and rotating the piston outer forward and backward so that it approaches and recedes from the piston inner moves it to a low compression ratio position and a high compression ratio position (for example, Japanese Patent Application Laid-open No. 11-117779), and a known system (2) in which a piston outer is fitted in an axially slidable manner around the outer periphery of a piston inner, an upper hydraulic chamber and a lower hydraulic chamber are formed between the piston inner and the piston outer, and supplying hydraulic pressure alternately to these hydraulic chambers moves the piston outer to a low compression ratio position and a high compression ratio position (for example, Japanese Patent Publication No. 7-113330).

Depending on the running conditions of the internal combustion engine, it may be necessary for the compression ratio to be switched between three or more stages, but it is difficult to satisfy such a requirement with the above-mentioned conventional system (1) or (2). Furthermore, in the conventional system (1), since it is necessary to rotate the piston outer in order to switch the compression ratio, the shape of the top face of the piston outer is restricted by the shape of the ceiling of the combustion chamber or the arrangement of intake and exhaust valves, and it cannot be set freely.

DISCLOSURE OF INVENTION

It is therefore an object of the present invention to provide an internal combustion engine variable compression ratio system that enables the compression ratio to be appropriately switched between three stages, that is, a low compression ratio, a medium compression ratio, and a high compression ratio, without rotating the piston outer.

In order to attain the above-mentioned object, in accordance with an aspect of the present invention, there is provided an internal combustion engine variable compression ratio system that includes a piston inner connected to a connecting rod via a piston pin, a piston outer that, while being fitted around the outer periphery of the piston inner so that the piston outer can slide only in the axial direction and having an outer end face facing a combustion chamber, is capable of moving to a low compression ratio position close to the piston inner, a high compression ratio position close to the combustion chamber, and at least one medium compression ratio position between the low compression ratio position and the high compression ratio position, and at least two sets of raising means disposed in line in the axial direction between the piston inner and the piston outer, each set of raising means including a movable raising member, the movable raising members being individually capable of pivoting between a non-raised position and a raised position around the axis of the piston inner and outer, the piston outer being held at the low compression ratio position when two of the movable raising members are pivoted to the non-raised position, the piston outer being held at the medium compression ratio position when only one of the movable raising members is pivoted to the raised position, and the piston outer being held at the high compression ratio position when two of the movable raising members are pivoted to the raised position.

In accordance with this aspect, it is possible to appropriately switch the position of the piston outer between at least three stages, that is, the low compression ratio position, the medium compression ratio position, and the high compression ratio position, only by pivoting at least two movable raising members between just two positions, that is, the non-raised position and the raised position, thereby enabling a close correspondence with various running conditions of the internal combustion engine.

Moreover, since the piston outer does not rotate relative to the piston inner even when the position of the piston outer is being controlled, by making the shape of the top face of the piston outer, which faces the combustion chamber, match the shape of the combustion chamber or the arrangement of intake and exhaust valves, the compression ratio when the piston outer is at the high compression ratio position can be increased effectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

FIG. 1 to FIG. 21 show a first embodiment of the present invention;

FIG. 1 is a vertical sectional front view of an essential part of an internal combustion engine equipped with a variable compression ratio system of the first embodiment of the present invention, FIG. 2 is an enlarged sectional view along line 2-2 in FIG. 1, showing a low compression ratio state, FIG. 3 is a sectional view along line 3-3 in FIG. 2, FIG. 4 is a sectional view along line 4-4 in FIG. 2, FIG. 5 is a sectional view along line 5-5 in FIG. 2, FIG. 6 is a sectional view along line 6-6 in FIG. 2, FIG. 7 is a sectional view along line 7-7 in FIG. 2, FIG. 8 is a sectional view along line 8-8 in FIG. 2, FIG. 9 is a view, corresponding to FIG. 2, showing a medium compression ratio state, FIG. 10 is a sectional view along line 10-10 in FIG. 9, FIG. 11 is a sectional view along line 11-11 in FIG. 9, FIG. 12 is a sectional view along line 12-12 in FIG. 9, FIG. 13 is a view, corresponding to FIG. 2 and FIG. 9, showing a high compression ratio state, FIG. 14 is a sectional view along line 14-14 in FIG. 13, FIG. 15 is a sectional view along line 15-15 in FIG. 13, FIG. 16 is a sectional view along line 16-16 in FIG. 13, FIG. 17 is a diagram for explaining the operation of each section in the low compression ratio state, FIG. 18 is a diagram for explaining the operation of each section in the medium compression ratio state, FIG. 19 is a diagram for explaining the operation of each section in the high compression ratio state, FIG. 21 is a sectional view along line 21-21 in FIG. 14.

BEST MODE FOR CARRYING OUT THE INVENTION

Modes for carrying out the present invention are explained below with reference to embodiments of the present invention shown in the attached drawings.

A first embodiment of the present invention is now explained with reference to FIG. 1 to FIG. 21.

Figure 1:
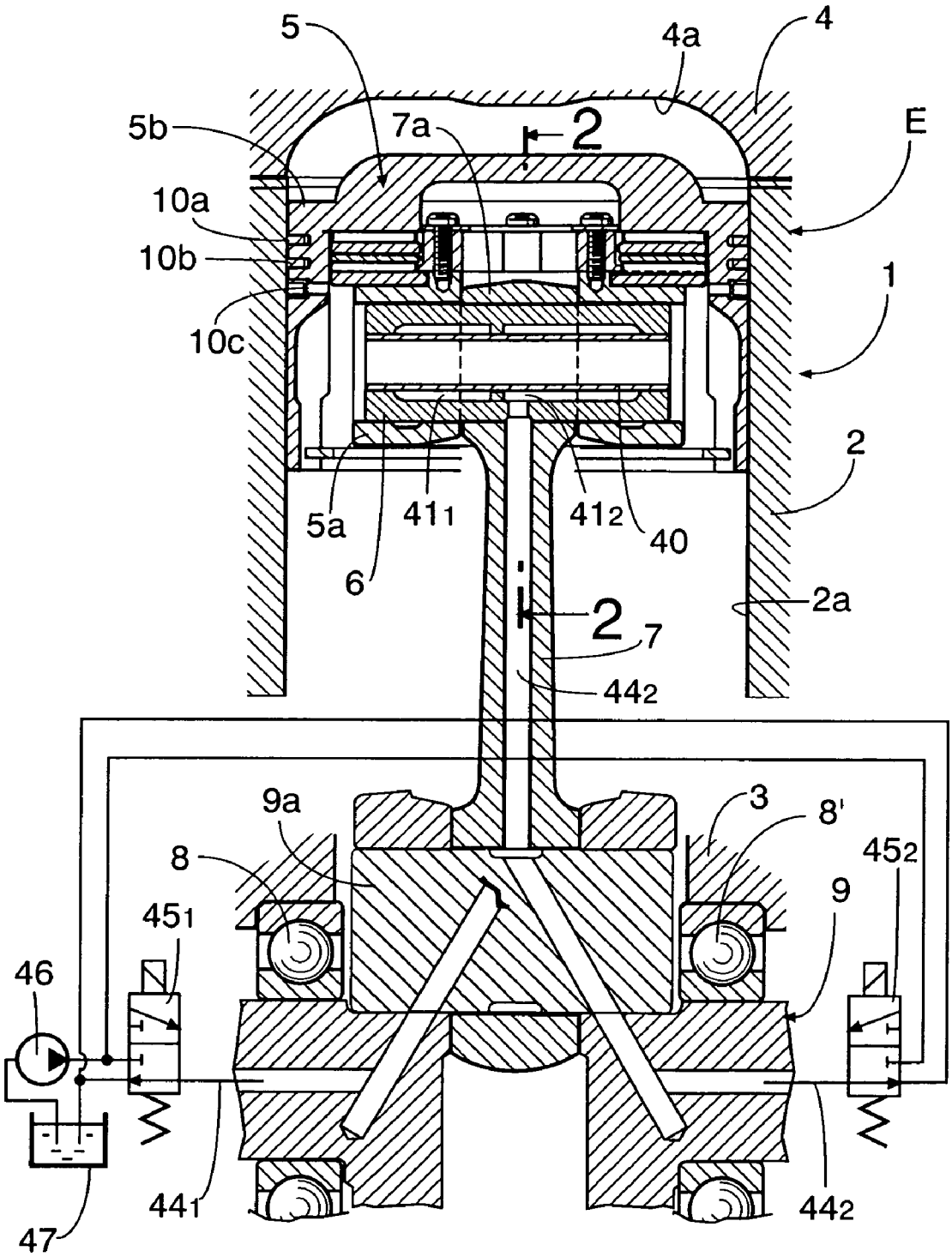
Figure 2:
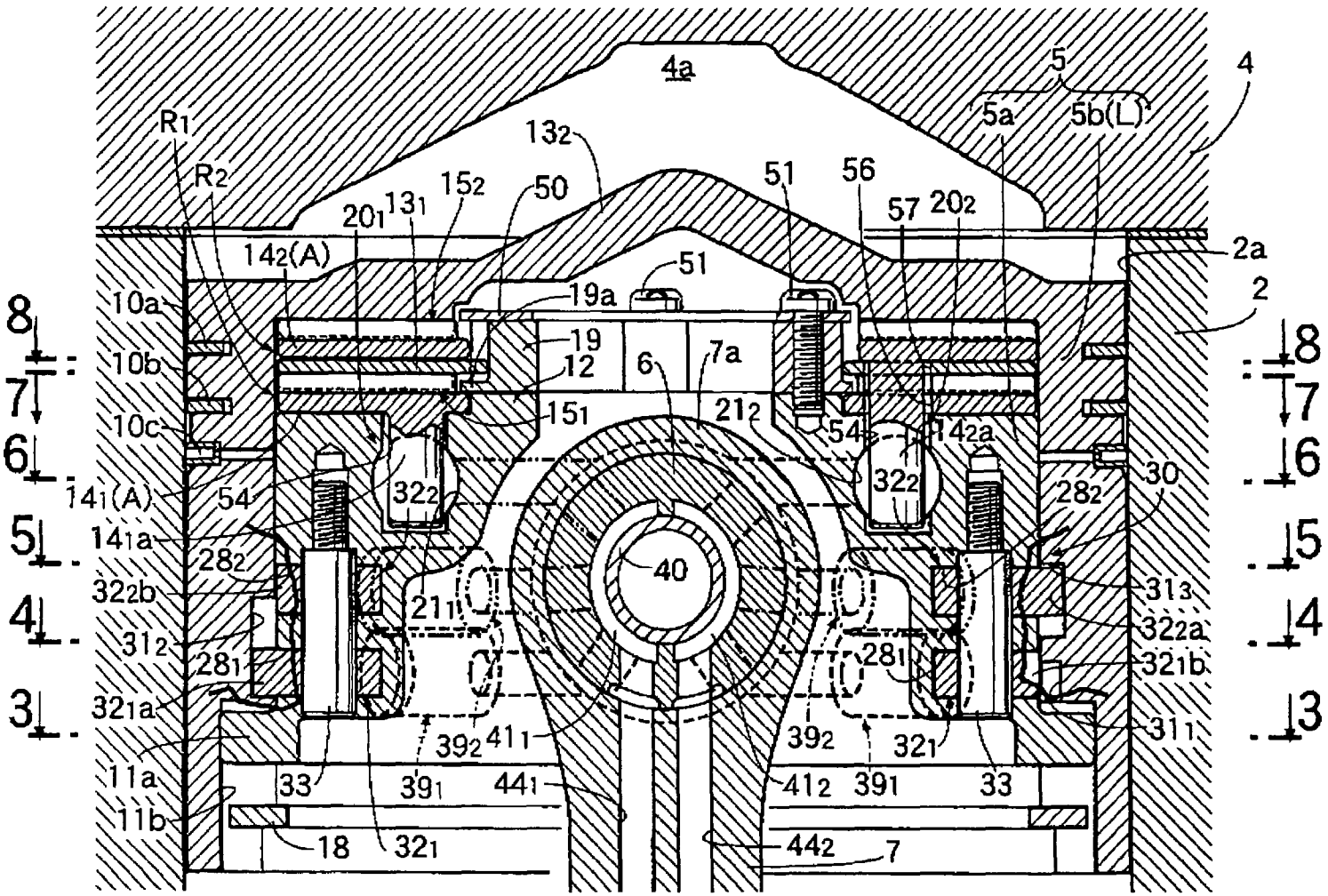

In FIG. 1 and FIG. 2, an engine main body 1 of an internal combustion engine E includes a cylinder block 2 having a cylinder bore 2*a*, a crankcase 3 joined to the lower end of the cylinder block 2, and a cylinder head 4 joined to the upper end of the cylinder block 2 and having a combustion chamber 4*a* extending from the cylinder bore 2*a*. A piston 5 is fitted slidably in the cylinder bore 2*a*, a little end 7*a* of a connecting rod 7 is connected to the piston 5 via a piston pin 6, and a big end 7*b* of the connecting rod 7 is connected to a crankpin 9*a* of a crankshaft 9 rotatably supported in the crankcase 3 via a pair of left and right bearings 8 and 8'.

The piston 5 includes a piston inner 5*a* and a piston outer 5*b*, the piston inner 5*a* being connected to the little end 7*a* of the connecting rod 7 via the piston pin 6, and the piston outer 5*b*, whose top face faces the combustion chamber 4*a*, being slidably fitted onto an outer peripheral face of the piston inner 5*a* and into an inner peripheral face of the cylinder bore 2*a*. A plurality of piston rings 10*a* to 10*c* are fitted around the outer periphery of the piston outer 5*b*, the plurality of piston rings 10*a* to 10*c* being in intimate sliding contact with the inner peripheral face of the cylinder bore 2*a*.

Figure 3:
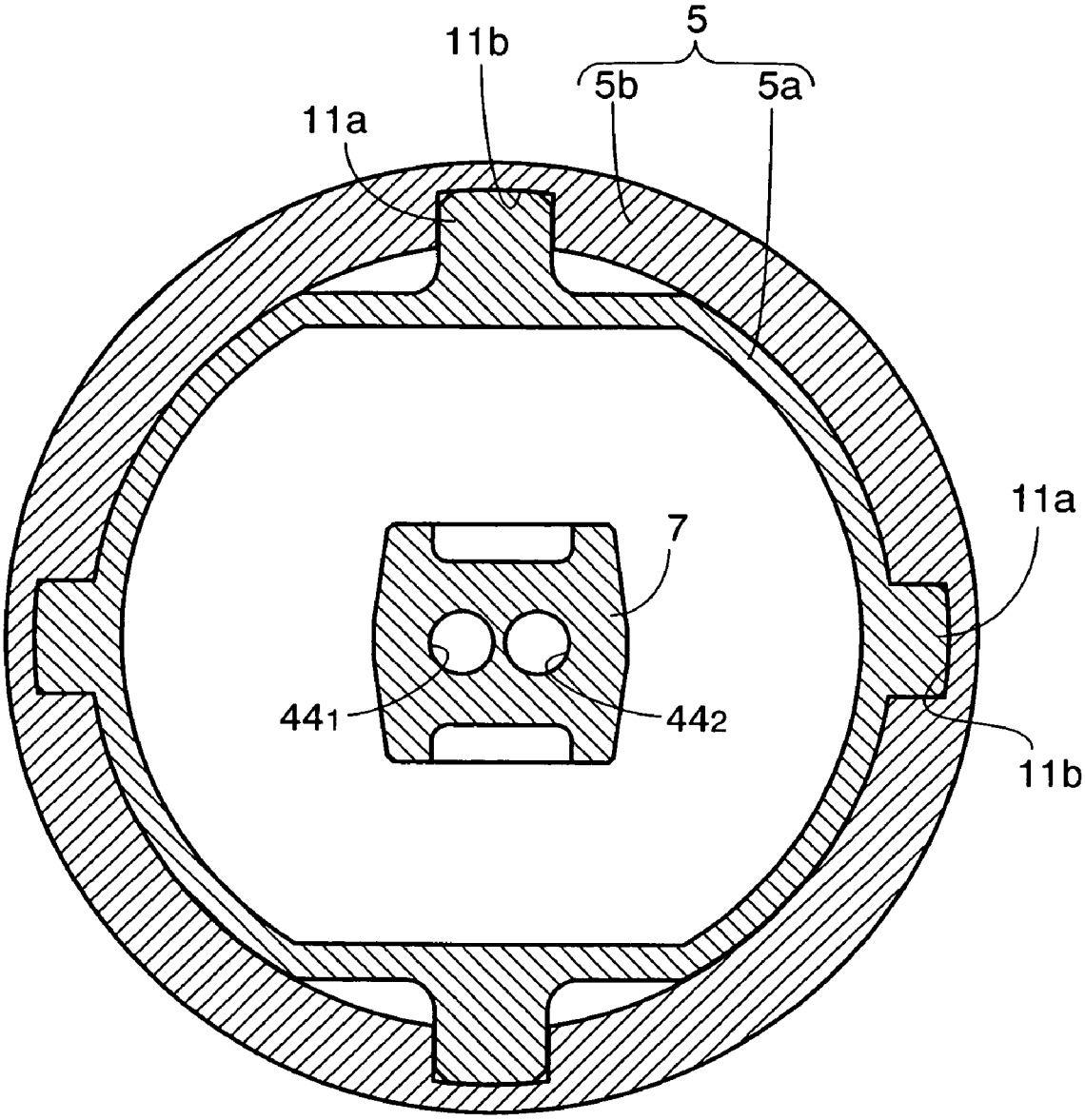

As shown in FIG. 2 and FIG. 3, a plurality of spline teeth 11*a* and spline grooves 11*b* extending in the axial direction of the piston 5 and engaging with each other are formed on the sliding mating faces of the piston inner and outer 5*a* and 5*b* respectively, thereby preventing relative rotation of the piston inner and outer 5*a* and 5*b* around their axes.

As shown in FIG. 2, FIG. 7, FIG. 8 and FIG. 20A to FIG. 20E, first and second raising means $R_1$ and $R_2$ are disposed in line in the axial direction between the piston inner 5*a* and the piston outer 5*b*.

The first raising means $R_1$ is formed from an annular first movable raising member $\mathbf{14}_1$ pivotably fitted around a pivot portion 12 formed coaxially and integrally on an upper face of the piston inner 5*a*, and an annular first fixed raising member $\mathbf{13}_1$ axially and slidably spline-coupled to a cylindrical pivot 19 secured coaxially to an upper end face of the pivot portion 12 by means of screws 51. This annular first movable raising member $\mathbf{14}_1$ is capable of reciprocatingly pivoting between a non-raised position A and a raised position B set around the pivot portion 12 on the upper face of the piston inner 5*a*, and a first cam mechanism $\mathbf{15}_1$ that can allow the first fixed raising member $\mathbf{13}_1$ to move up and down along the cylindrical pivot 19 accompanying the reciprocating pivoting is provided between the annular first movable raising member $\mathbf{14}_1$ and the annular first fixed raising member $\mathbf{13}_1$.

As is clear from FIG. 20A to FIG. 20E, the first cam mechanism $\mathbf{15}_1$ is formed from an upwardly-facing cam $\mathbf{15}_1a$ having peaks and valleys formed on an upper face of the annular first movable raising member $\mathbf{14}_1$ and arranged in a rectangular wave shape in the peripheral direction, and a downwardly-facing cam $\mathbf{15}_1b$ similarly having peaks and valleys formed on a lower face of the annular first fixed raising member $\mathbf{13}_1$ and arranged in a rectangular wave shape in the peripheral direction; when the first movable raising member $\mathbf{14}_1$ is at the non-raised position A, the peaks and valleys of the upwardly-facing cam $\mathbf{15}_1a$ mesh with the valleys of the downwardly-facing cam $\mathbf{15}_1b$, thus allowing the first fixed raising member $\mathbf{13}_1$ to move to a downward position; and when the annular first movable raising member $\mathbf{14}_1$ is at the raised position B, the peaks of the upwardly-facing cam $\mathbf{15}_1a$ abut against the peaks of the downwardly-facing cam $\mathbf{15}_1b$, thus holding the annular first fixed raising member $\mathbf{13}_1$ in a raised position.

The second raising means $R_2$ includes an annular second movable raising member $\mathbf{14}_2$ pivotably and axially slidably fitted around the pivot portion 12 on a flat upper face of the first fixed raising member $\mathbf{13}_1$. This annular second movable raising member $\mathbf{14}_2$ is capable of reciprocatingly pivoting between a non-raised position A and a raised position B set around the cylindrical pivot 19 on the upper face of the first fixed raising member $\mathbf{13}_1$, and a second cam mechanism $\mathbf{15}_2$ that can allow the piston outer 5*b* to move up and down accompanying the reciprocating pivoting is provided between the annular second movable raising member $\mathbf{14}_2$ and the piston outer 5*b*.

The second cam mechanism $\mathbf{15}_2$ is formed from an upwardly-facing cam $\mathbf{15}_2a$ having peaks and valleys formed on an upper face of the annular second movable raising member $\mathbf{14}_2$ and arranged in a rectangular wave shape in the peripheral direction, and a downwardly-facing cam $\mathbf{15}_2b$ similarly having peaks and valleys formed on a lower face of a second fixed raising member $\mathbf{13}_2$, which also serves as a top wall of the piston outer 5*b*, and arranged in a rectangular wave shape in the peripheral direction; when the second movable raising member $\mathbf{14}_2$ is at the non-raised position A, the peaks and valleys of the upwardly-facing cam $\mathbf{15}_2a$ mesh with the valleys and peaks of the downwardly-facing cam $\mathbf{15}_2b$, thus allowing the piston outer 5*b* to move downward relative to the piston inner 5*a*; and when the annular second movable raising member $\mathbf{14}_2$ is at the raised position B, the peaks of the upwardly-facing cam $\mathbf{15}_2a$ abut against the peaks of the downwardly-facing cam $\mathbf{15}_2b$, thereby holding the piston outer 5*b* at a raised position.

The pivot portion 12 is divided into a plurality of blocks arranged at intervals in the peripheral direction so as to accept the little end 7*a* of the connecting rod 7. A flange 19*a* is formed at the lower end of the pivot 19, the flange 19*a* retaining the upper face of the first movable raising member $\mathbf{14}_1$ and preventing it from becoming detached from the pivot portion 12. Furthermore, a retaining ring 50 is secured to the upper end of the pivot 19 by means of the screws 51, the retaining ring 50 facing the upper face of the second movable raising member $\mathbf{14}_1$ and preventing it from becoming detached from the pivot 19.

Figures 20A, 20B, 20C, 20D, 20E:
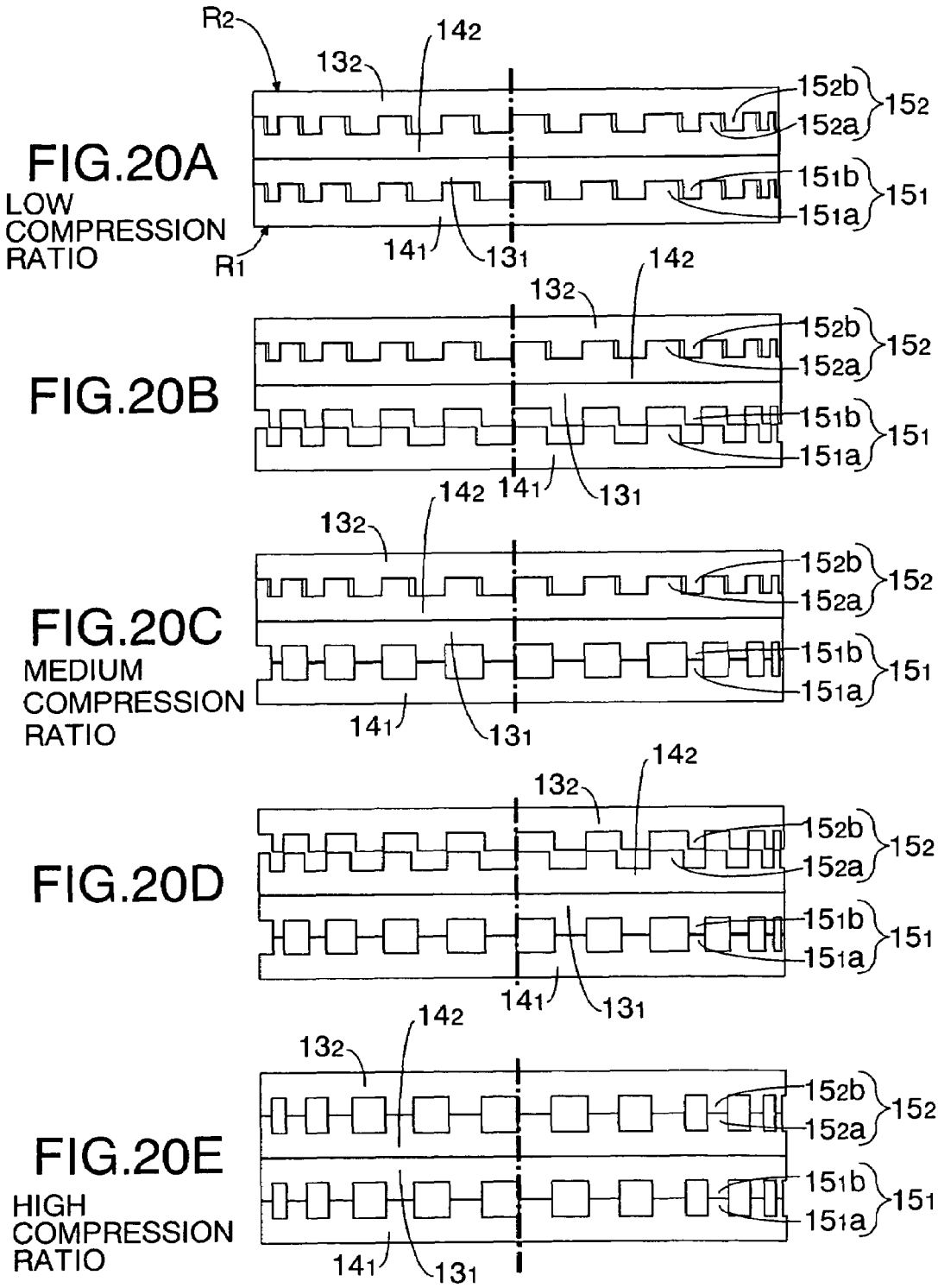
FIG. 20A to FIG. 20E are diagrams for explaining the operation of the first and second raising means.

Accordingly, when the first and second movable raising members $\mathbf{14}_1$ and $\mathbf{14}_2$ are both controlled so as to be at the non-raised position A, in both of the first and second cam mechanisms $\mathbf{15}_1$ and $\mathbf{15}_2$ the peaks and valleys of the upwardly-facing cams $\mathbf{15}_1a$ and $\mathbf{15}_2a$ mesh with the valleys and peaks of the downwardly-facing cams $\mathbf{15}_1b$ and $\mathbf{15}_2b$, thus controlling the piston outer 5*b* at a low compression ratio position L in which the piston outer 5*b* is the closest to the piston inner 5*a* (see FIG. 20A); when the first movable raising member $\mathbf{14}_1$ is pivoted to the raised position B while holding the second movable raising member $\mathbf{14}_2$ at the non-raised position A, in the first cam mechanism $\mathbf{15}_1$ the peaks of the upwardly-facing cam $\mathbf{15}_1a$ abut against the peaks of the downwardly-facing cam $\mathbf{15}_1b$, thereby controlling the piston outer 5*b* at a medium compression ratio position M in which the piston outer 5*b* is pushed up from the low compression ratio position L toward the combustion chamber 4*a* by a predetermined distance (see FIG. 20C); and when the second movable raising member $\mathbf{14}_1$ is also pivoted to the raised position B, in the second cam mechanism $\mathbf{15}_2$ also the peaks of the upwardly-facing cam $\mathbf{15}_2a$ abut against the peaks of the downwardly-facing cam $\mathbf{15}_2b$, thereby controlling the piston outer 5*b* at a high compression ratio position H in which the piston outer 5*b* is the closest to the combustion chamber 4*a* (see FIG. 20E).

In the first and second cam mechanisms $\mathbf{15}_1$ and $\mathbf{15}_2$, since the upwardly-facing cams $\mathbf{15}_1a$ and $\mathbf{15}_2a$ and the downwardly-facing cams $\mathbf{15}_1b$ and $\mathbf{15}_2b$ are formed in the rectangular wave shape, and the cams are set at a small pitch, it is possible to set at a small value the angle through which each of the movable raising members $\mathbf{14}_1$ and $\mathbf{14}_2$ pivots from the non-raised position A to the raised position B, and at the same time it is possible to increase the area of the top face of each peak.

Figure 13:
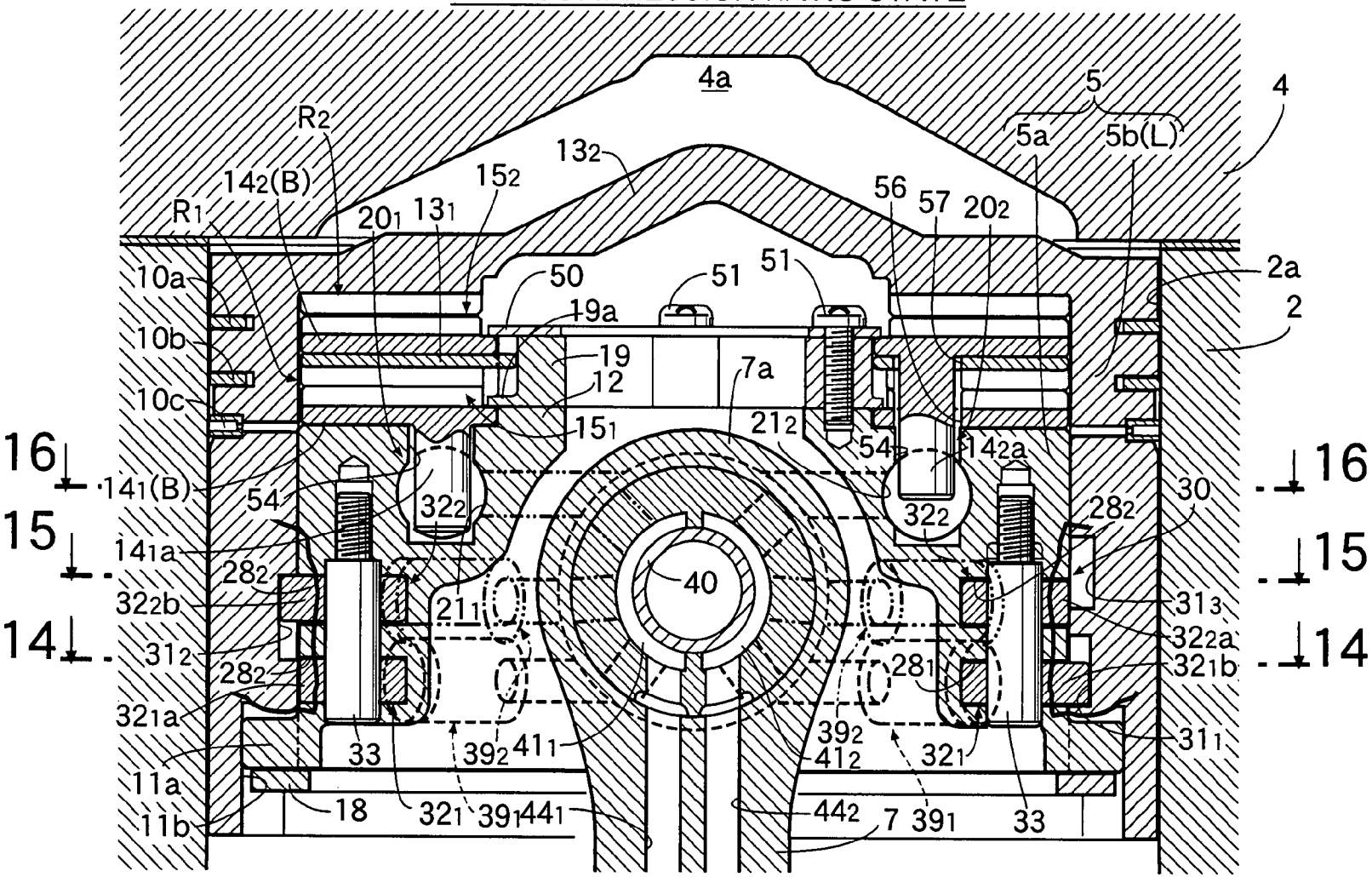
Figure 19:
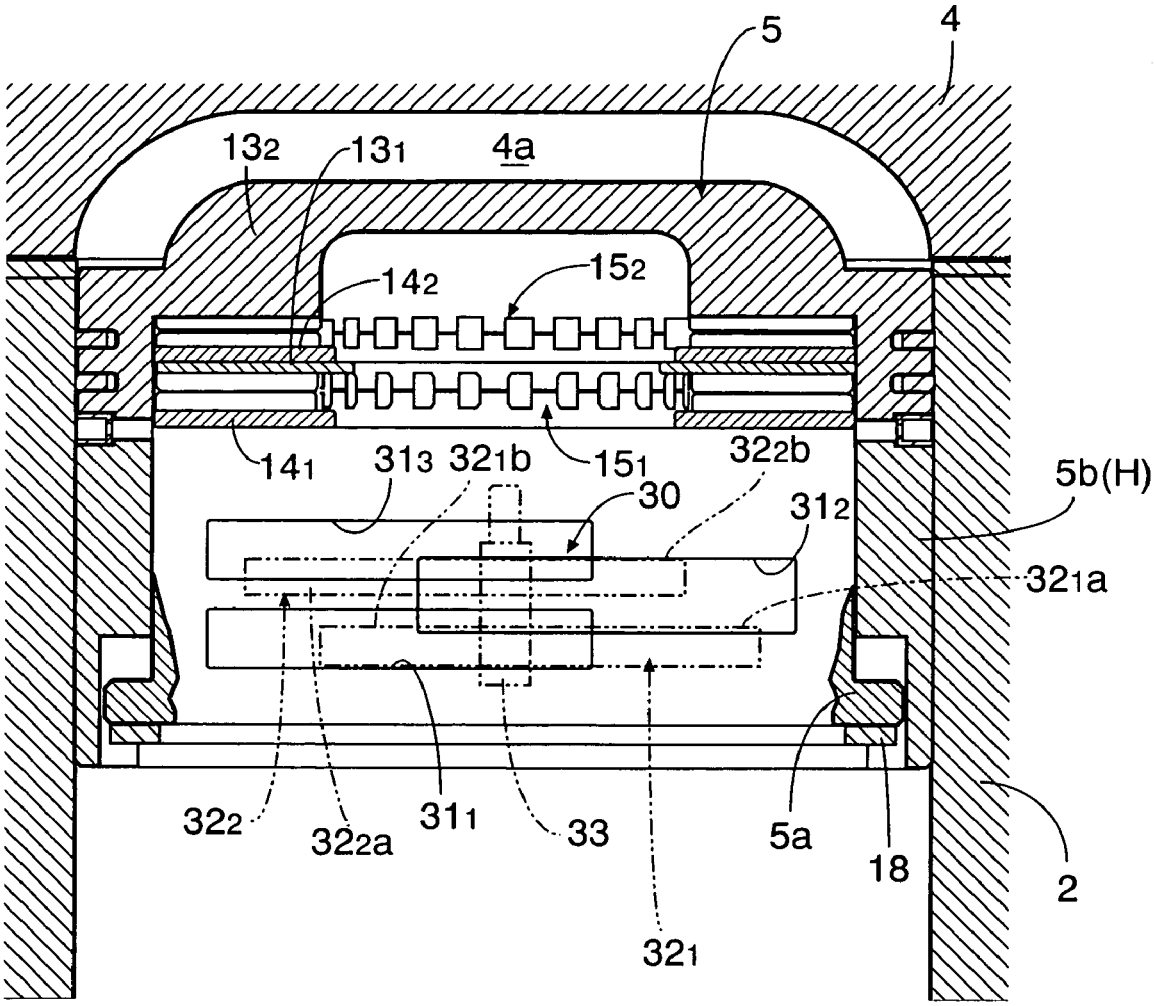

As shown in FIG. 13 and FIG. 19, as restraining means for preventing the piston outer 5*b* from moving toward the combustion chamber 4*a* beyond the high compression ratio position H when the piston outer 5*b* has reached the high compression ratio position H, a stopper ring 18, which abuts against a lower end face of the piston inner 5*a*, is latched onto an inner peripheral face of a lower end part of the piston outer 5*b*.

Figure 6:
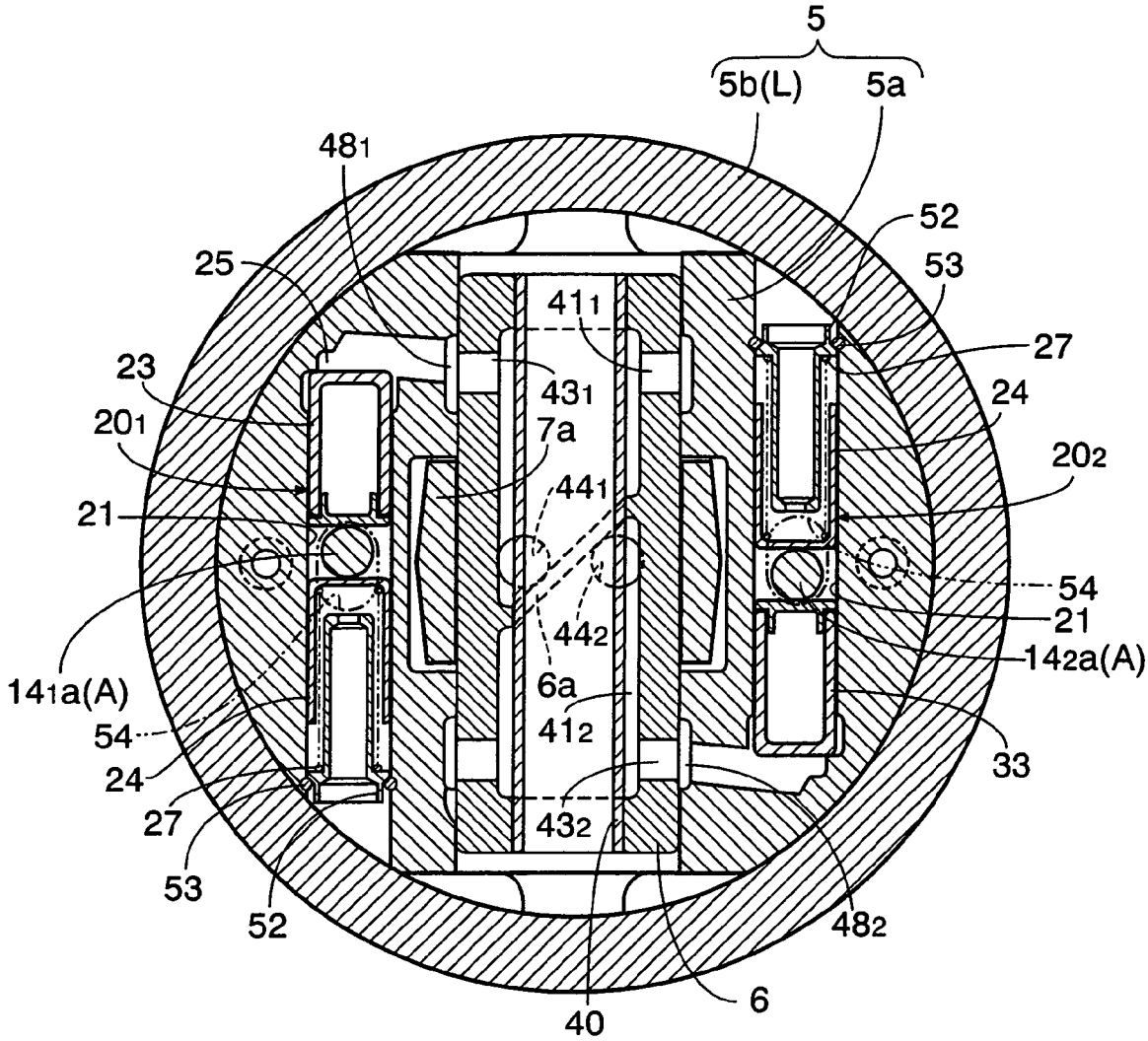
Figure 7:
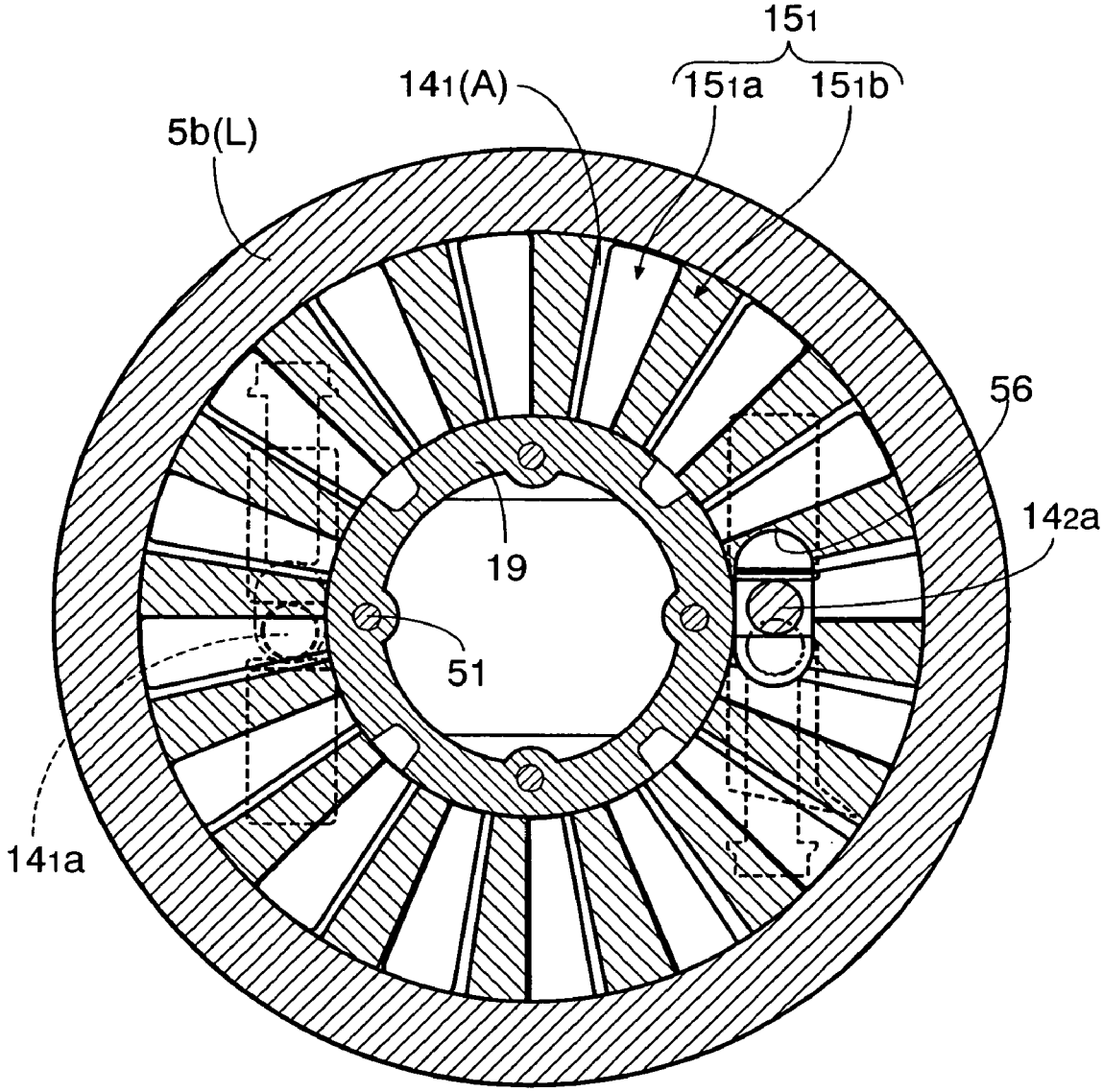
Figure 8:
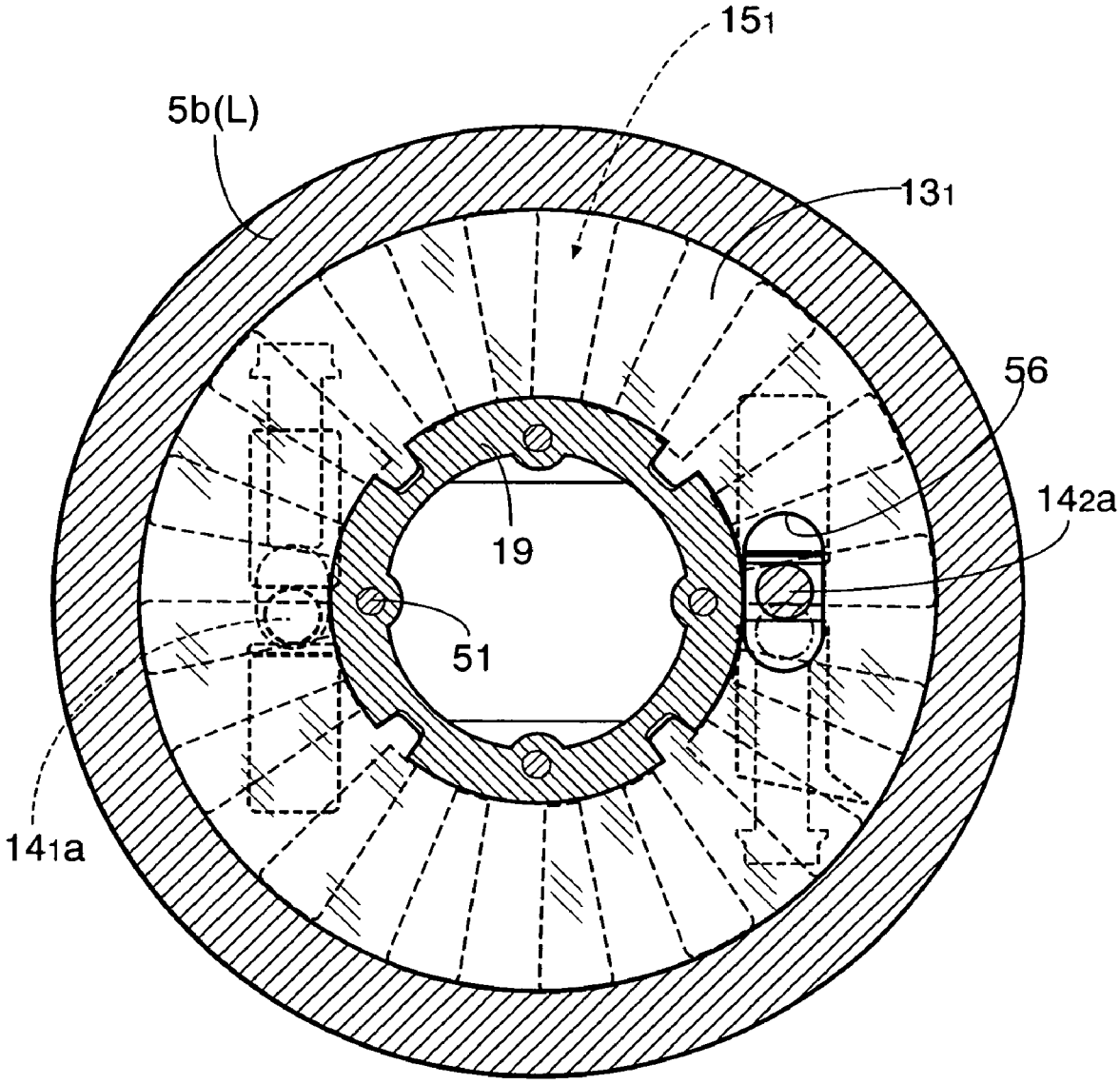
Figure 9:
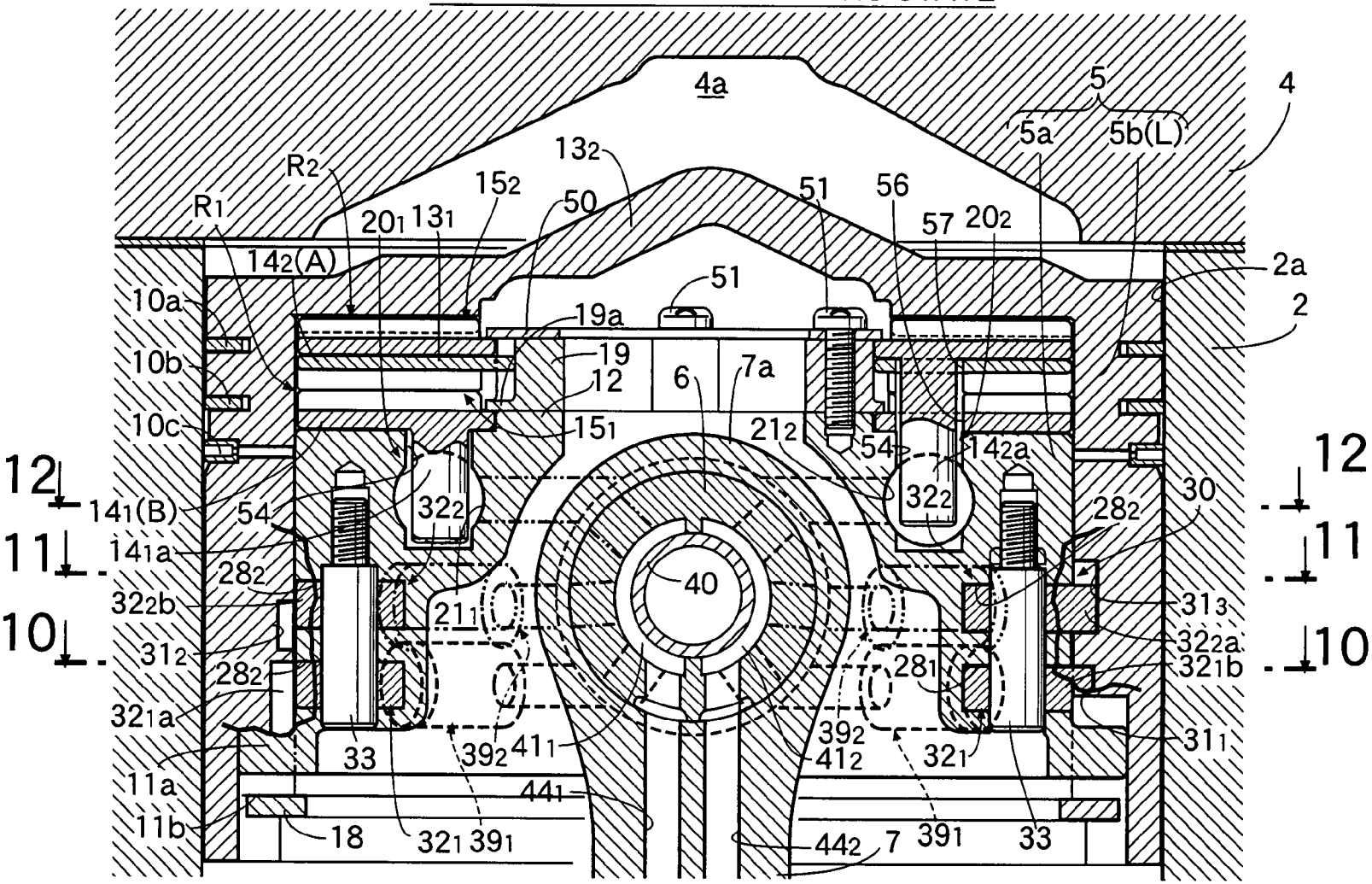
Figure 10:
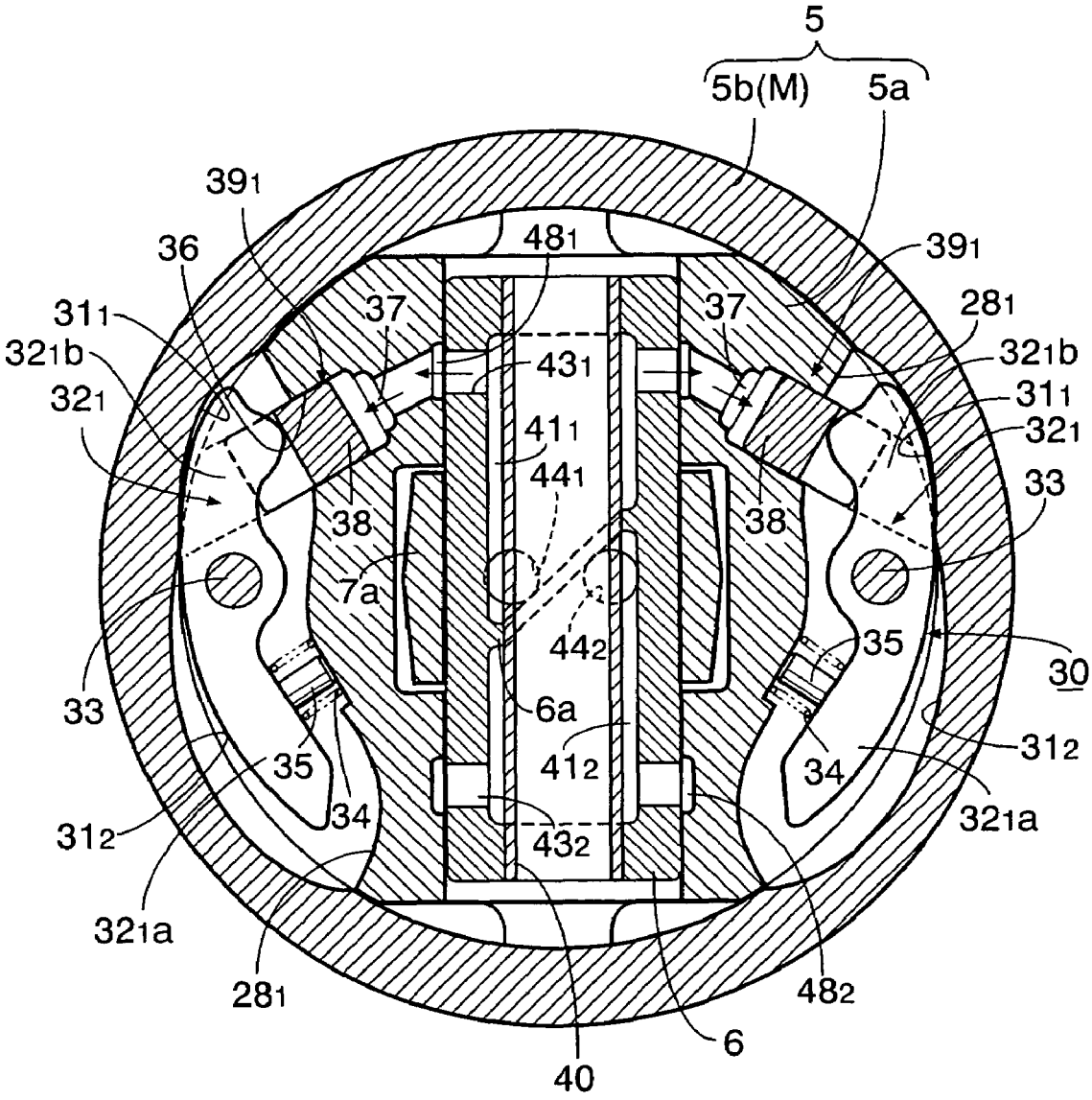
Figure 11:
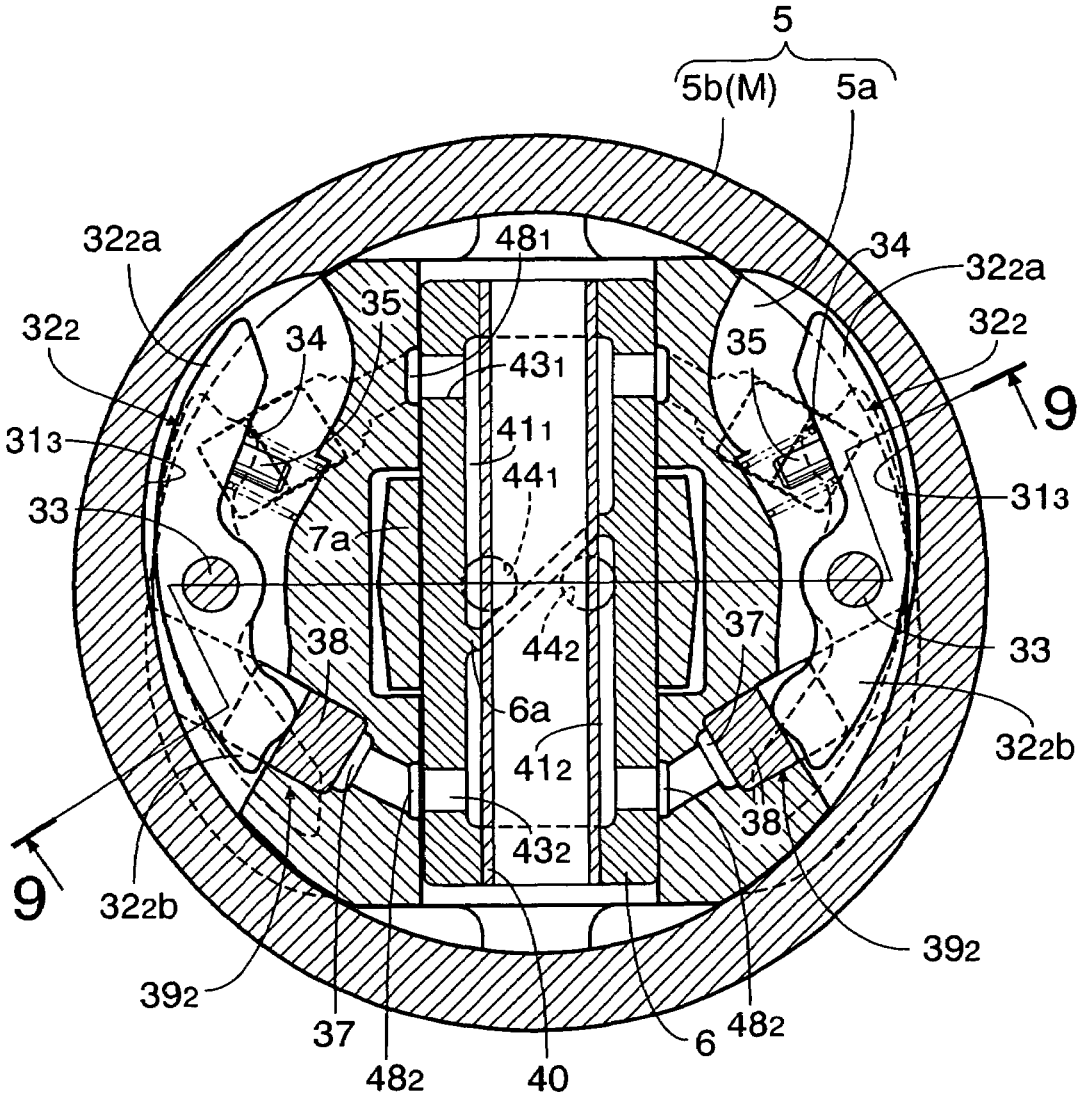

In FIG. 2 and FIG. 6, provided between the piston inner 5*a* and the first movable raising member $\mathbf{14}_1$ are a first actuator $\mathbf{20}_1$ for alternately pivoting the first movable raising member $\mathbf{14}_1$ to the non-raised position A and the raised position B, and a second actuator $\mathbf{20}_2$ for alternately pivoting the second movable raising member $\mathbf{14}_2$ to the non-raised position A and the raised position B. These first and second actuators $\mathbf{20}_1$ and $\mathbf{20}_2$ are now explained.

The first actuator $\mathbf{20}_1$ includes a cylinder hole 21 bored in one side of the piston inner 5*a* in parallel to the piston pin 6, and a pressure-bearing pin $\mathbf{14}_1a$ having its extremity facing the cylinder hole 21 through a long hole 54 bored in a lower face of the first movable raising member $\mathbf{14}_1$ and running through an upper wall of a middle section of the cylinder hole 21. The long hole 54 is arranged so that there is no interference with movement of the pressure-bearing pin $\mathbf{14}_1a$, which moves together with the first movable raising member $\mathbf{14}_1$, between the non-raised position A and the raised position B.

An operating plunger 23 and a return plunger 24 are slidably fitted in the cylinder hole 21 with the pressure-bearing pin $\mathbf{14}_1a$ disposed therebetween. The return plunger 24 has a bottomed cylindrical shape, a cylindrical retainer 52 fixed to an open end portion of the cylinder hole 21 by means of a retaining ring 53 is inserted into the return plunger 24, and a coil-form return spring 27 is provided in compression between the retainer 52 and the return plunger 24, the return spring 27 urging the return plunger 24 toward the pressure-bearing pin $\mathbf{14}_1a$.

A hydraulic chamber 25, which the inner end of the operating plunger 23 faces, is formed within the cylinder hole 21; when hydraulic pressure is supplied to the hydraulic chamber 25, the operating plunger 23 receives the hydraulic pressure and pivots the first movable raising member $\mathbf{14}_1$ to the raised position B via the pressure-bearing pin $\mathbf{14}_1a$, and when the hydraulic pressure is released from the hydraulic chamber 25, the return plunger 24 returns the first movable raising member $\mathbf{14}_1$ to the non-raised position A, via the pressure-bearing pin $\mathbf{14}_1a$, by virtue of the urging force of the return spring 27.

The non-raised position A for the first movable raising member $\mathbf{14}_1$ is defined by the operating plunger 23 abutting against the base of the cylinder hole 21 as a result of being pushed by the pressure-bearing pin $\mathbf{14}_1a$ (see FIG. 6). The raised position B for the first movable raising member $\mathbf{14}_1$ is defined by the return plunger 24 abutting against the retainer 52 as a result of being pushed by the pressure-bearing pin $\mathbf{14}_1a$ (see FIG. 12 and FIG. 16).

The second actuator $\mathbf{20}_2$ has an arrangement that is centrosymmetric with the first actuator $\mathbf{20}_1$ relative to the axis of the piston inner 5*a*, and apart from a pressure-bearing pin $\mathbf{14}_2a$, which is projectingly provided on a lower face of the second movable raising member $\mathbf{14}_2$, parts of the second actuator $\mathbf{20}_2$ corresponding to those of the first actuator $\mathbf{20}_1$ are referred to by the same reference numerals and symbols, and explanation thereof is thus omitted.

In the second actuator $\mathbf{20}_2$ also, when hydraulic pressure is supplied to a hydraulic chamber 25, an operating plunger 23 receives the hydraulic pressure and pivots the second movable raising member $\mathbf{14}_1$ to the raised position B via the pressure-bearing pin $\mathbf{14}_2a$, and when the hydraulic pressure is released from the hydraulic chamber 25, a return plunger 24 returns the second movable raising member $\mathbf{14}_2$ to the non-raised position A, via the pressure-bearing pin 14*a*, by virtue of the urging force of a return spring 27.

Long holes 56 and 57, which are similar to the long hole 54, are bored in the first movable and fixed raising members $\mathbf{14}_1$ and $\mathbf{13}_1$ so that there is no interference with movement of the pressure-bearing pin $\mathbf{14}_2a$ of the second actuator $\mathbf{20}_2$, which moves together with the second movable raising member $\mathbf{14}_2$, between the non-raised position A and the raised position B.

The first and second actuators $\mathbf{20}_1$ and $\mathbf{20}_2$ allow the piston outer 5*b* to move between the low compression ratio position L and the high compression ratio position H by virtue of a spontaneous external force such as combustion pressure in the combustion chamber 4*a*, compression pressure of a gas mixture, inertial force of the piston outer 5*b*, frictional resistance that the piston outer 5*b* receives from the inner face of the cylinder bore 2*a*, intake negative pressure acting on the piston outer 5*b*, etc., which act so that the piston inner and outer 5*a* and 5*b* are moved toward or away from each other in the axial direction.

Piston outer latching means 30 is provided between the piston inner 5*a* and the piston outer 5*b*, the piston outer latching means 30 latching the piston outer 5*b* at three positions, that is, the low compression ratio position L, the medium compression ratio position M, and the high compression ratio position H. The piston outer latching means 30 is explained with reference to FIG. 2, FIG. 4, FIG. 5, and FIG. 9 to FIG. 20E.

Figure 4:
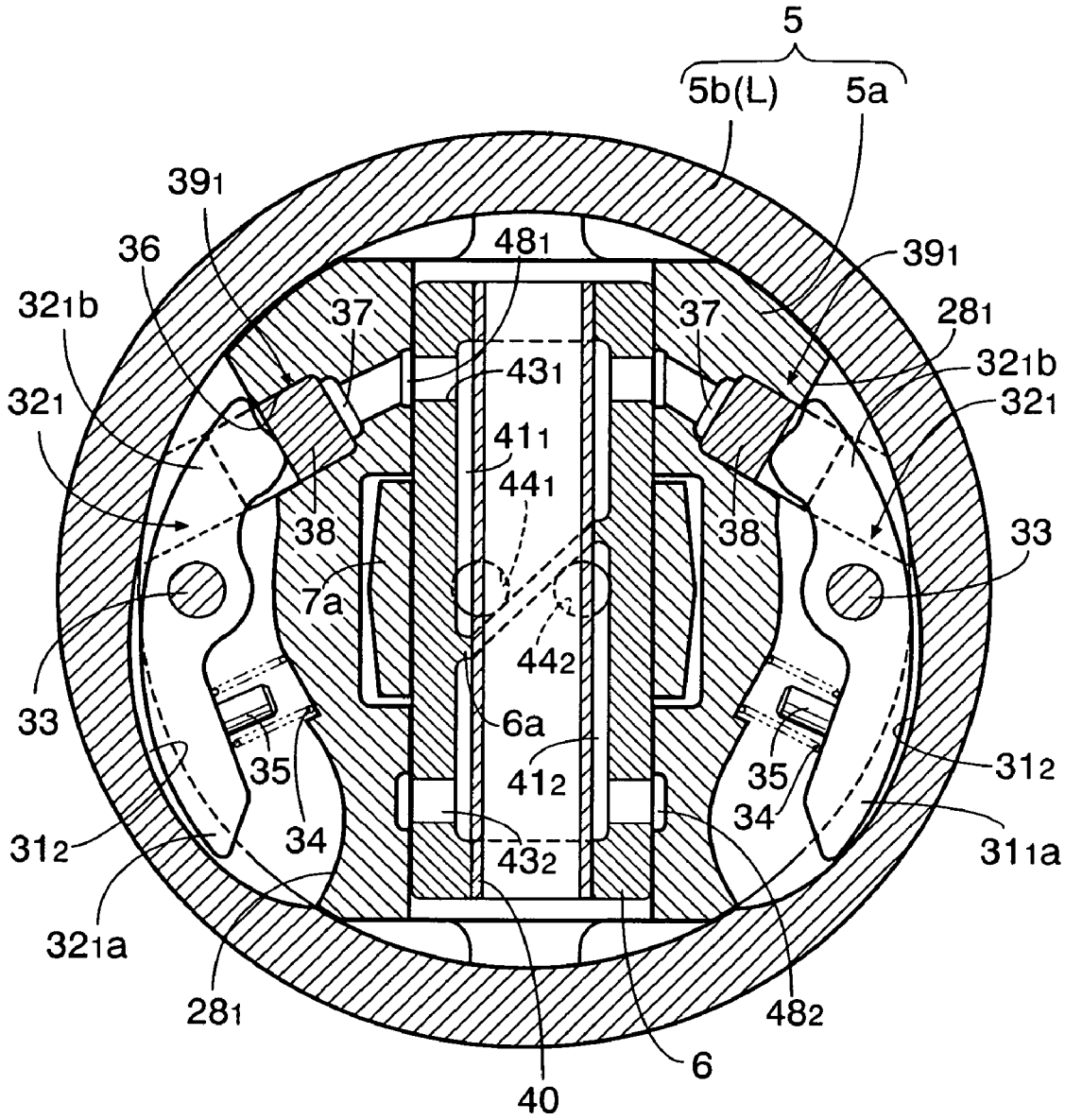
Figure 5:
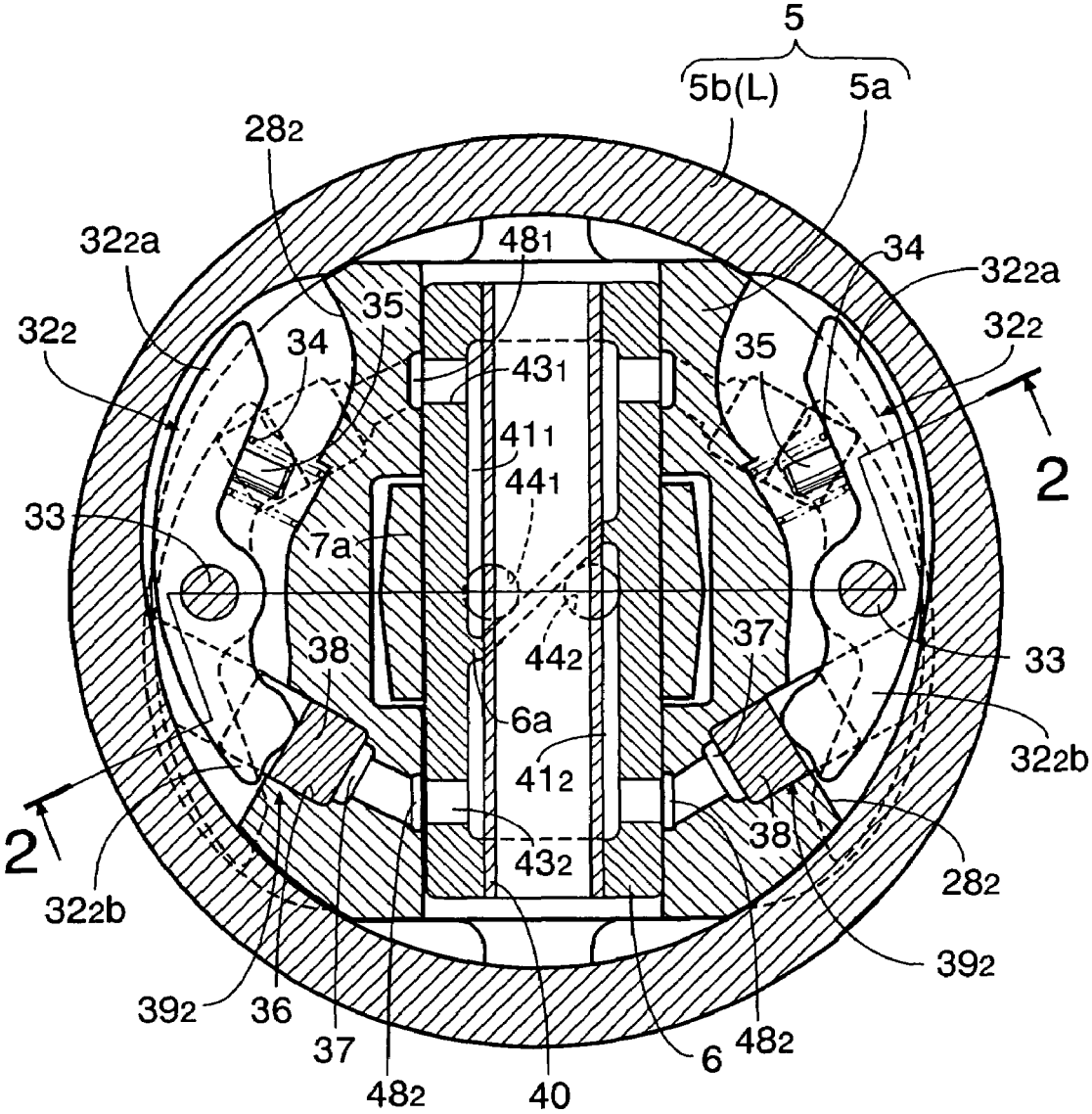

As shown in FIG. 2 and FIG. 20A to FIG. 20E, three sets of two latching channels $\mathbf{31}_1$ to $\mathbf{31}_3$ extending in the peripheral direction and arranged vertically are formed in the inner peripheral face of the piston inner 5*a* so that the channels of each set face each other, and the sets of latching channels are called, from the bottom to the top, the first latching channels $\mathbf{31}_1$, the second latching channels $\mathbf{31}_2$, and the third latching channels $\mathbf{31}_3$. The first and third latching channels $\mathbf{31}_1$ and $\mathbf{31}_3$ are arranged in phase, and the second latching channels $\mathbf{31}_2$ are displaced in the peripheral direction of the piston outer 5*b* relative to the first and third latching channels $\mathbf{31}_1$ and $\mathbf{31}_3$ while partially overlapping the first and third latching channels $\mathbf{31}_1$ and $\mathbf{31}_3$. As shown in FIGS. 4 and 5, the piston inner 5*a* has provided in its outer peripheral wall two sets of lower and upper housing grooves $\mathbf{28}_1$ and $\mathbf{28}_2$ extending in the peripheral direction so as to sandwich the piston pin 6; in each of the lower housing grooves $\mathbf{28}_1$ a first latching lever $\mathbf{32}_1$ is swingably mounted on the piston inner 5*a* via a pivot shaft 33 parallel to the axis of the piston inner 5*a*, and in each of the upper housing grooves $\mathbf{28}_2$ a second latching lever $\mathbf{32}_2$ is swingably mounted on the piston inner 5*a* via the pivot shaft 33. The first and second latching levers $\mathbf{32}_1$ and $\mathbf{32}_2$ include a long arm $\mathbf{32}_1a$, $\mathbf{32}_2a$ and a short arm $\mathbf{32}_1b$, $\mathbf{32}_2b$ extending from the swing center in opposite directions from each other, the long arm 32*a* of the first latching lever $\mathbf{32}_1$ and the short arm 32*b* of the second latching lever $\mathbf{32}_2$ can engage with the second latching channel $\mathbf{31}_2$, and the short arm 32*b* of the first latching lever $\mathbf{32}_1$ and the long arm 32*a* of the second latching lever $\mathbf{32}_2$ can engage with the first and third latching channels $\mathbf{31}_1$ and $\mathbf{31}_3$ respectively. The channel width of the first and third latching channels $\mathbf{31}_1$ and $\mathbf{31}_3$ is set to be larger than the thickness of the first and second latching levers $\mathbf{32}_1$ and $\mathbf{32}_2$ by an amount corresponding to the amount of lift of the piston outer 5*b* by the first or second raising means $R_1$ or $R_2$, and the channel width of the second latching channel $\mathbf{31}_2$ is set to be yet larger.

First and second driving means $\mathbf{39}_1$ and $\mathbf{39}_2$ are connected to the first and second latching levers $\mathbf{32}_1$ and $\mathbf{32}_2$ and swing them individually.

In FIG. 4, the first driving means $\mathbf{39}_1$ is formed from a coil-form operating spring 34 that is disposed between the base of the lower housing groove $\mathbf{28}_1$ and the long arm $\mathbf{32}_1a$ of the first latching lever $\mathbf{32}_1$ and urges the long arm $\mathbf{32}_1a$ in a direction in which it is engaged with the second latching channel $\mathbf{31}_2$, and a hydraulic piston 38 that is fitted into a cylinder hole 36 formed in the piston inner 5*a* and abuts against the tip of the short arm $\mathbf{32}_1b$ of the first latching lever $\mathbf{32}_1$ so as to push it toward the second latching channel $\mathbf{31}_2$. In this arrangement, a positioning projection 35 is formed on the long arm $\mathbf{32}_1a$ of the first latching lever $\mathbf{32}_1$ so as to prevent the operating spring 34 from moving around. A hydraulic chamber 37, which the inner end of the hydraulic piston 38 faces, is defined in the cylinder hole 36.

Figure 15:
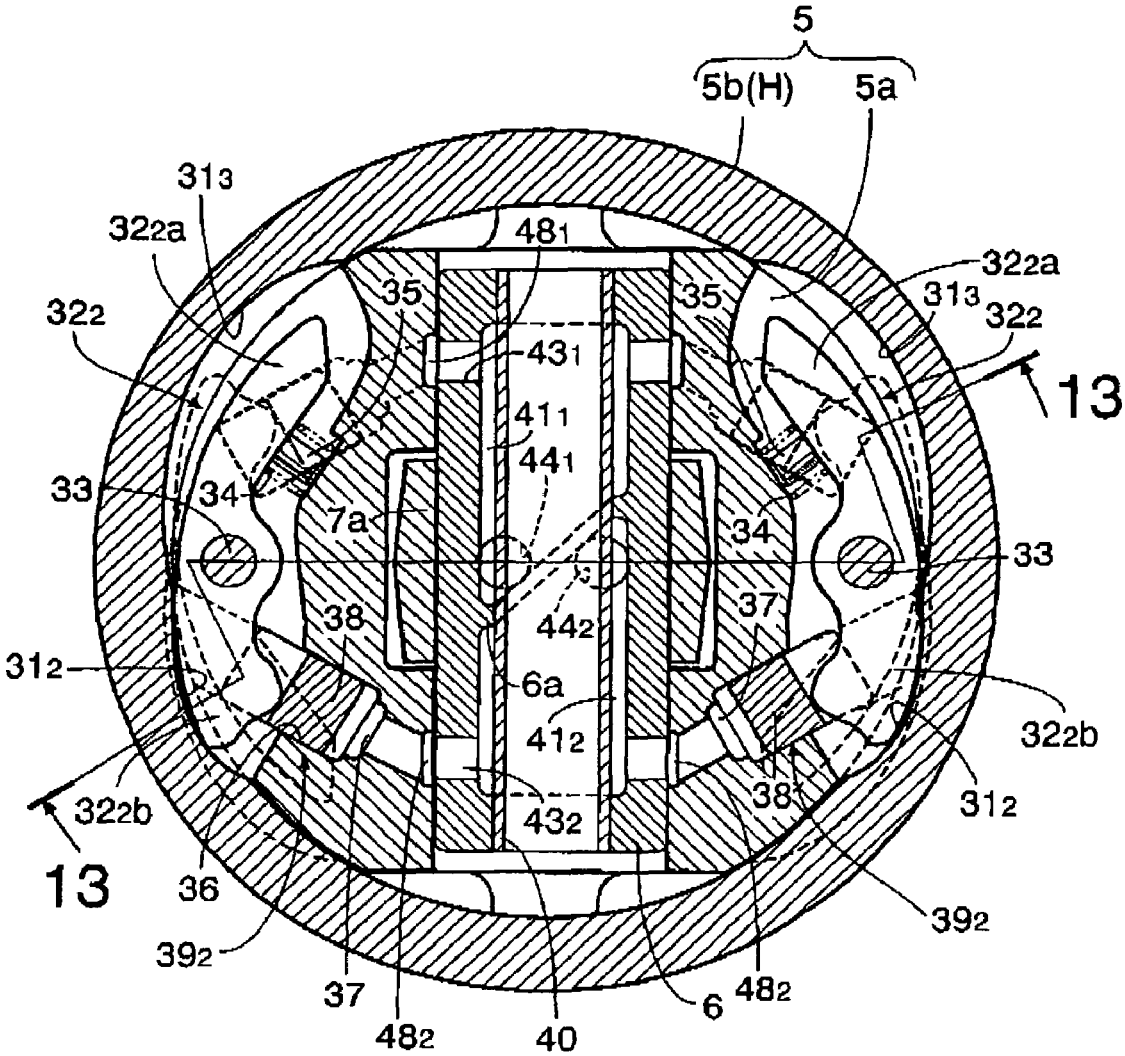
Figure 21:
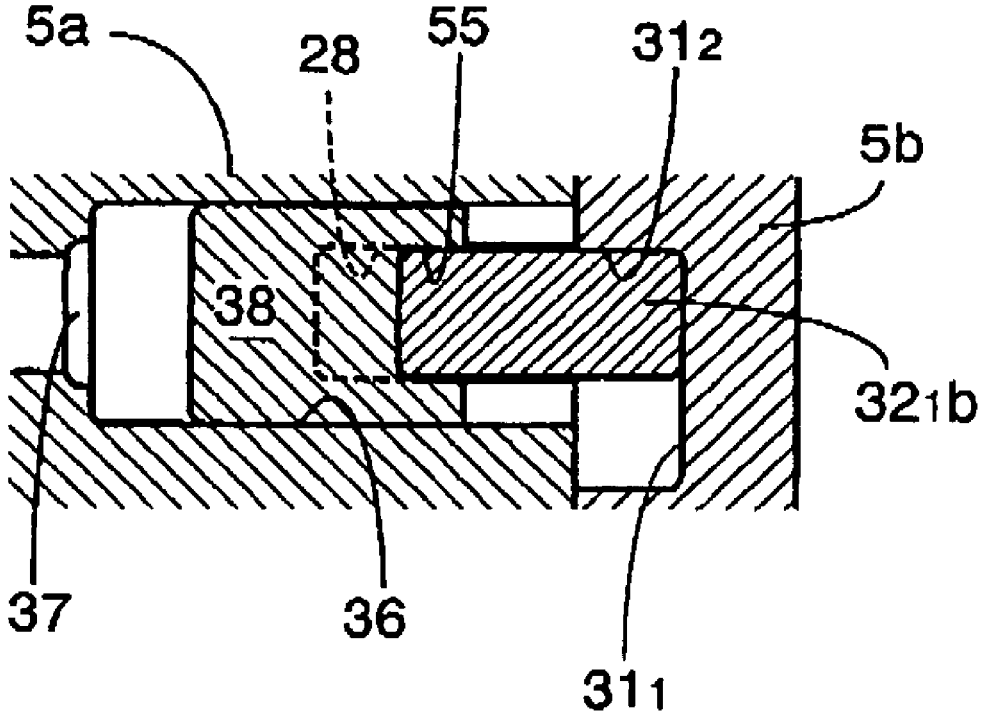
Figures 22A, 22B, 22C, 22D, 22E:
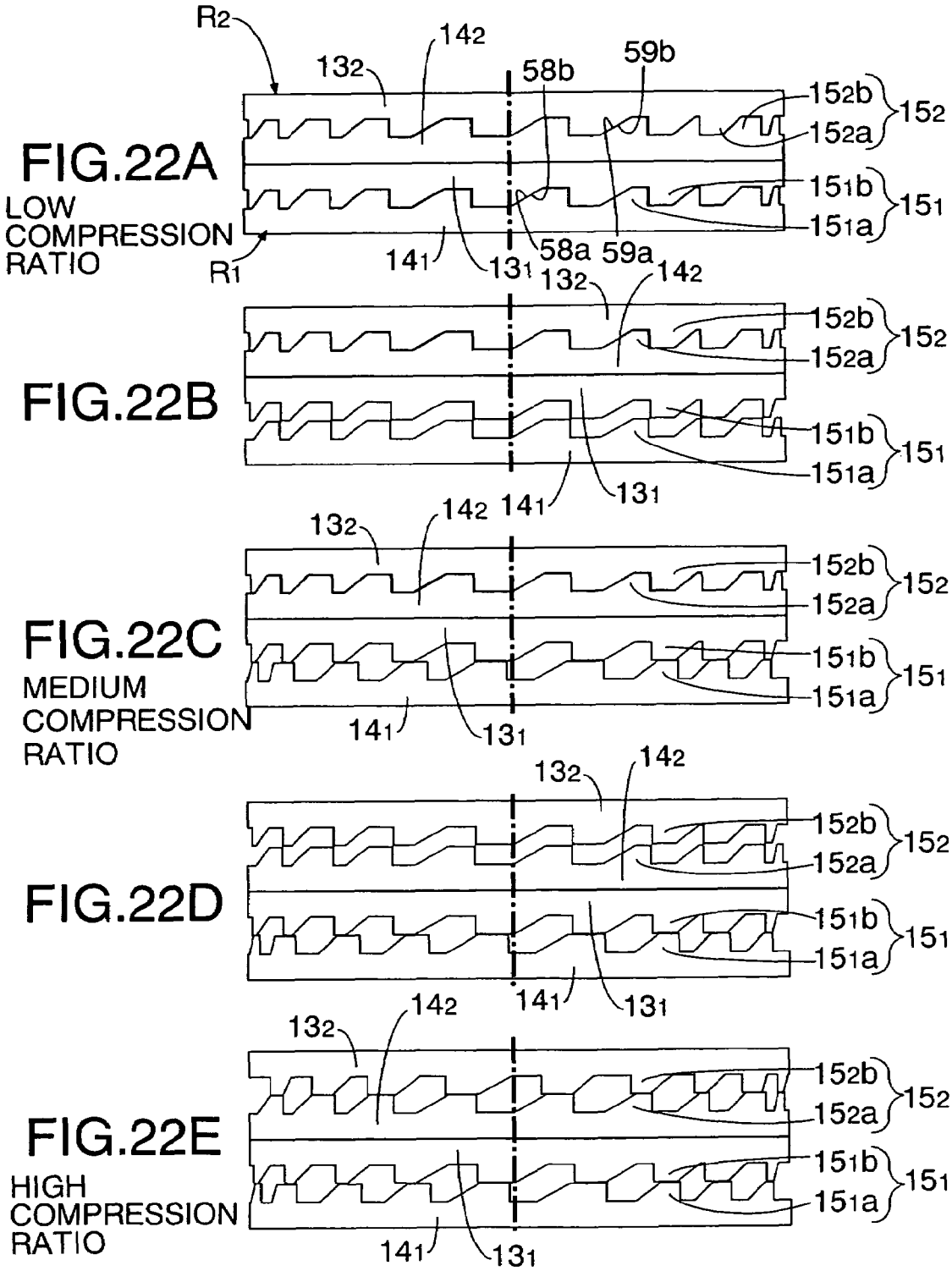
FIG. 22A to FIG. 22E are diagrams corresponding to FIG. 20A to FIG. 20E, showing a second embodiment of the present invention.

As shown in FIG. 15 and FIG. 21 in particular, the cylinder holes 36 of the piston inner 5*a* are formed by cutting away opposite side walls of each of the housing grooves $\mathbf{28}_1$ and $\mathbf{28}_2$ at a diameter larger than that of the groove width of each of the housing grooves $\mathbf{28}_1$ and $\mathbf{28}_2$ so that the cylinder holes 36 open on an outer peripheral face of the piston inner 5*a*, and the tips of the hydraulic pistons 38 fitted into the cylinder holes 36 are provided with cutouts 55 that receive the tips of the second arms $\mathbf{32}_1b$ and $\mathbf{32}_2b$ of the latching levers $\mathbf{32}_1$ and $\mathbf{32}_2$. Therefore, even when a part of the hydraulic pistons 38 is exposed within the housing grooves $\mathbf{28}_1$ and $\mathbf{28}_2$, since the whole length of the hydraulic pistons 38 can be supported on the inner peripheral face of the cylinder holes 36, and the load of the short arms $\mathbf{32}_1b$ and $\mathbf{32}_2b$ act on an axially middle point of the hydraulic pistons 38, the operation of the hydraulic pistons 38 can be stabilized.

Since, as shown in FIG. 5, the second driving means $\mathbf{39}_2$ has basically the same arrangement as that of the first driving means $\mathbf{39}_1$, parts of the second driving means $\mathbf{39}_2$ corresponding to those of the first driving means $\mathbf{39}_1$ are referred to using the same reference numerals and symbols, and detailed explanation thereof is omitted. This second driving means $\mathbf{39}_2$ is arranged so that an operating spring 34 urges the long arm $\mathbf{32}_2a$ of the second latching lever $\mathbf{32}_2$ in a direction in which it engages with the third latching channel $\mathbf{31}_3$, and when the hydraulic piston 38 receives hydraulic pressure, it pushes the short arm $\mathbf{32}_2b$ of the second latching lever $\mathbf{32}_2$ in a direction in which it engages with the second latching channel $\mathbf{31}_2$ (See FIG. 15.).

Accordingly, when the piston outer 5*b* comes to the low compression ratio position L, when the hydraulic pressure is released from the hydraulic chamber 37 in the first driving means $\mathbf{39}_1$ (See FIG. 4), the long arm $\mathbf{32}_1a$ of the first latching lever $\mathbf{32}_1$ engages with the second latching channel $\mathbf{31}_2$ and abuts against a lower face of the latching channel $\mathbf{31}_2$ by virtue of the urging force of the operating spring 34, thus holding the piston outer 5*b* at the low compression ratio position L.

When the piston outer 5*b* comes to the medium compression ratio position M, hydraulic pressure is supplied to the hydraulic chamber 37 in the first driving means $\mathbf{39}_1$ (See FIG. 10) so as to move the hydraulic piston 38, the short arm $\mathbf{32}_1b$ of the first latching lever $\mathbf{32}_1$ engages with the first latching channel $\mathbf{31}_1$ and abuts against an upper face of the latching channel $\mathbf{31}_1$, and at the same time hydraulic pressure is released from the hydraulic chamber 37 in the second driving means $\mathbf{39}_2$ (See FIG. 11), and the long arm $\mathbf{32}_2a$ of the second latching lever $\mathbf{32}_2$ engages with the third latching channel $\mathbf{31}_3$, and abuts against a lower face of the latching channel $\mathbf{31}_3$ by virtue of the urging force of the operating spring 34, thereby holding the piston outer 5*b* at the medium compression ratio position M.

Figure 14:
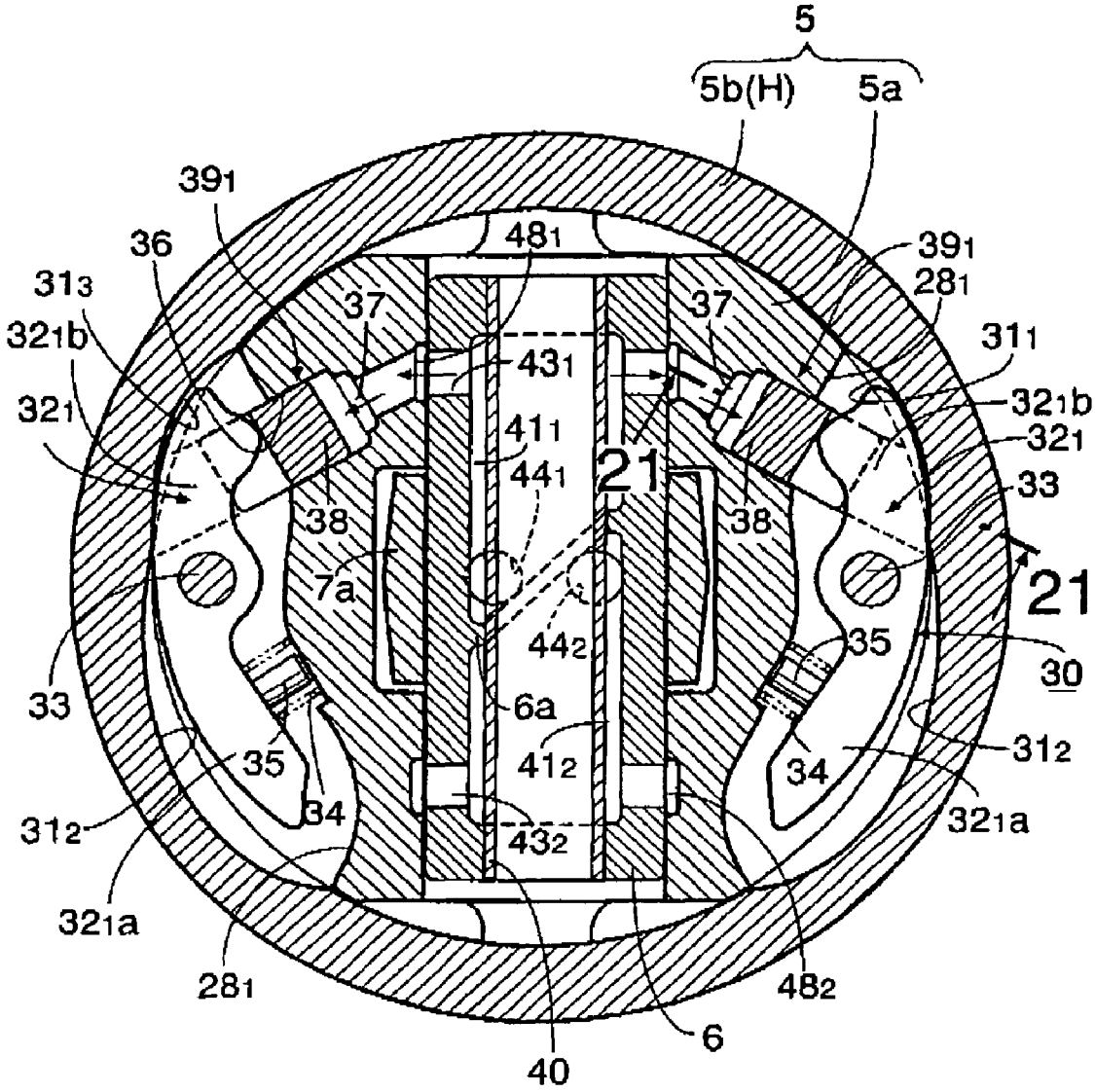

As shown ion FIGS. 14 and 15, when the piston outer 5*b* comes to the high compression ratio position H, hydraulic pressure is supplied to the hydraulic chamber 37 of each of the first and second driving means $\mathbf{39}_1$, $\mathbf{39}_2$ so as to move the respective hydraulic piston 38, the short arm $\mathbf{32}_1b$ of the first latching lever $\mathbf{32}_1$ engages with the first locking channel $\mathbf{31}_1$, and the short arm $\mathbf{32}_2b$ of the second latching lever $\mathbf{32}_2$ engages with the second latching channel $\mathbf{31}_2$, and abuts against an upper face of the latching channel $\mathbf{31}_2$, which in cooperation with the stopper ring 18 of the piston outer 5*b* abutting against the lower end face of the piston inner 5*a*, holds the piston outer 5*b* at the high compression ratio position H.

Referring again to FIG. 1, FIG. 2, and FIG. 4 to FIG. 6, tubular first and second oil chambers $\mathbf{41}_1$ and $\mathbf{41}_2$ are defined between the piston pin 6 and a sleeve 40 press-fitted in a hollow portion thereof, the first and second oil chambers $\mathbf{41}_1$ and $\mathbf{41}_2$ being separated by a dividing wall 6*a*. The first oil chamber $\mathbf{41}_1$ communicates with the hydraulic chamber 37 of the first actuator $20_1$ and the hydraulic chamber 37 of the first driving means $39_1$ via a plurality of first side holes $43_1$ in one end portion of the piston pin 6 and a first annular oil passage $48_1$ surrounding the first side holes $43_1$, and the second oil chamber $41_2$ communicates with the hydraulic chamber 25 of the second actuator $20_2$ and the hydraulic chamber 37 of the second driving means $39_2$ via a plurality of second side holes $43_2$ in the other end portion of the piston pin 6 and a second annular oil passage $48_2$ surrounding the second side holes $43_2$.

The first and second oil chambers $41_1$ and $41_2$ are also connected to first and second oil passages $44_1$ and $44_2$ provided so as to extend over the piston pin 6, the connecting rod 7, and the crankshaft 9, and these first and second oil passages $44_1$ and $44_2$ are switchably connected via first and second solenoid switch valves $45_1$ and $45_2$ to an oil pump 46, which is a common hydraulic pressure source, and an oil reservoir 47.

The operation of the first embodiment is now explained.

<Control for Low Compression Ratio> (see FIG. 1 to FIG. 8, FIG. 17 and FIG. 20A to FIG. 20E)

When, for example, the internal combustion engine E is being rapidly accelerated, to obtain a low compression ratio state in order to avoid knocking, as shown in FIG. 1 the first and second solenoid switch valves $45_1$ and $45_2$ are put in a nonenergized state, and both the first and second oil passages $44_1$ and $44_2$ are opened to the oil reservoir 47. By so doing, since the hydraulic chambers 25 of the first and second actuators $20_1$ and $20_2$ and the hydraulic chambers 37 of the first and second driving means $39_1$ and $39_2$ are all open to the oil reservoir 47, then as shown in FIG. 4 to FIG. 6 and FIG. 17, in both the first and second actuators $20_1$ and $20_2$, the return plungers 24 apply a force, due to the urging forces of the return springs 27, that rotates the first and second movable raising members $14_1$ and $14_2$ toward the non-raised positions A via the pressure-bearing pins $14_1a$ and $14_1b$. Furthermore, in both the first and second driving means $39_1$ and $39_2$, the operating springs 34 urge, by virtue of their urging forces, the long arms $32_1a$ and $32_2a$ of the first and second latching levers $32_1$ and $32_2$, which are axially supported on the piston inner 5*a*, toward the inner peripheral face of the piston outer 5*b*.

As a result, as shown in FIG. 20A, since the upwardly-facing cams $15_1a$ and $15_2a$ and the downwardly-facing cams $15_1b$ and $15_2b$ are in a phase in which they can mesh with each other in both the first and second cam mechanisms $15_1$ and $15_2$, when the piston outer 5*b* is pushed against the piston inner 5*a* by means of the pressure on the combustion chamber 4*a* side during the engine expansion stroke or compression stroke, when the piston outer 5*b* is pushed against the piston inner 5*a* by means of frictional resistance occurring between the piston rings 10*a* to 10*c* and the inner face of the cylinder bore 2*a* during the upward stroke of the piston 5, or when the piston outer 5*b* is pushed against the piston inner 5*a* by virtue of the inertial force of the piston outer 5*b* accompanying deceleration of the piston inner 5*a* during the second half of the downward stroke of the piston 5, the piston outer 5*b* is able to descend relative to the piston inner 5*a* down to the low compression ratio position L while making the upwardly-facing cams $15_1a$ and $15_2a$ and the downwardly-facing cams $15_1b$ and $15_2b$ of the first and second cam mechanisms $15_1$ and $15_2$ mesh with each other. In this way, when the piston outer 5*b* reaches the high compression ratio position H, the position of the long arm $32_1a$ of the first latching lever $32_1$ axially supported on the piston inner 5*a* and the position of the second latching channel $31_2$ of the piston outer 5*b* are aligned, and the long arm $32_1a$ engages with the second latching channel $31_2$ by virtue of the urging force of the operating spring 34 and abuts against the lower face of the latching channel $31_2$, thereby holding the piston outer 5*b* at the low compression ratio position L. During this process, the short arm $32_1b$ of the first latching lever $32_1$ is withdrawn inside the piston inner 5*a*. In this way, there is no play in the axial direction in the first and second cam mechanisms $15_1$ and $15_2$, and the piston inner and outer 5*a* and 5*b* can move up and down within the cylinder bore 2*a* as a unit while giving a low compression ratio.

On the other hand, the long arm $32_2a$ of the second latching lever $32_2$ engages with the third latching channel $31_3$ of the piston inner 5*a*, thus preparing for movement to a subsequent medium compression ratio state. During this process, the short arm $32_2b$ of the second latching lever $32_2$ is also withdrawn inside the piston inner 5*a*.

<Control for Medium Compression Ratio> (see FIG. 9 to FIG. 12, FIG. 18 and FIG. 20A to FIG. 20E)

Figure 12:
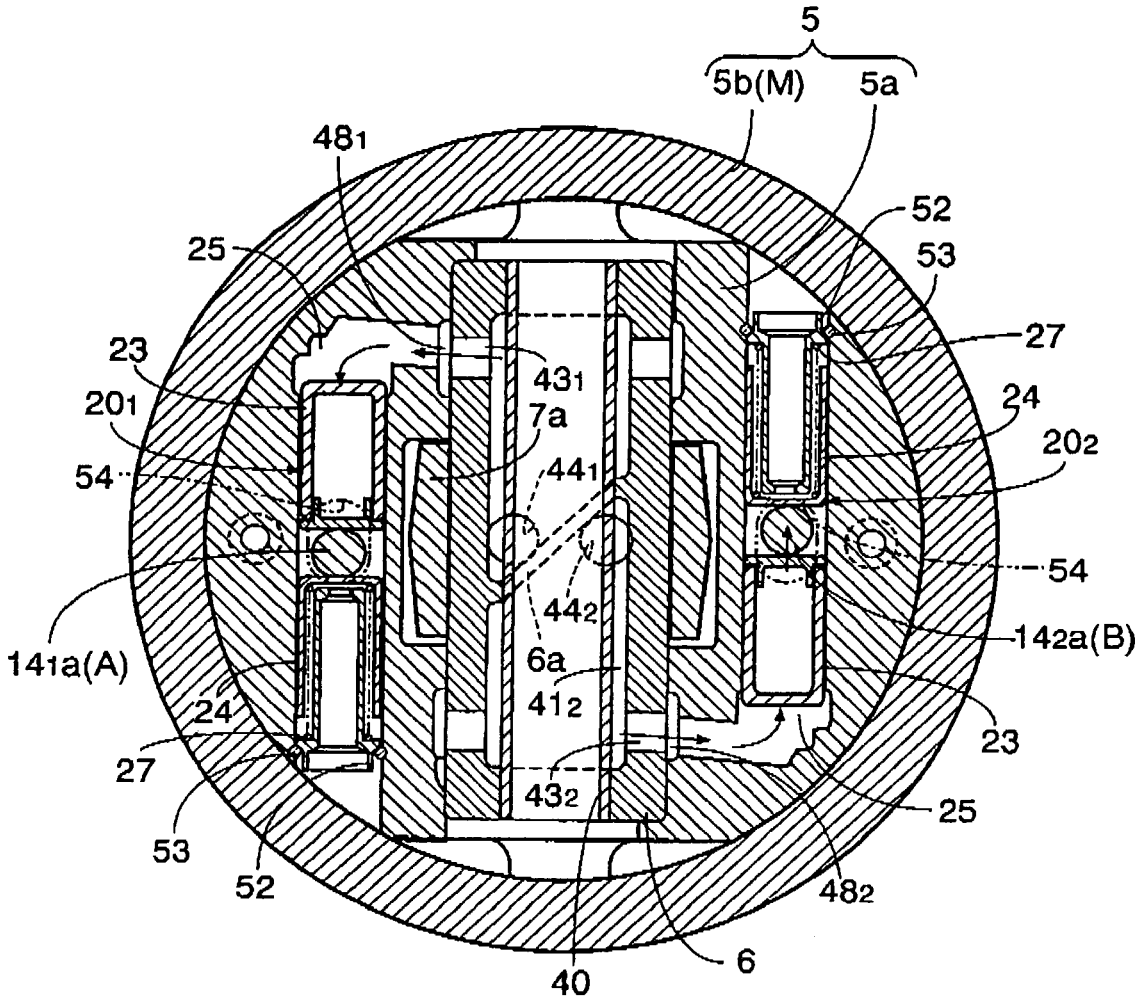

Subsequently, for example, to obtain a medium compression ratio state in order to improve the output when the internal combustion engine E is running at medium speed, the first solenoid switch valve $45_1$ is energized, thus connecting the first oil passage $44_1$ to the oil pump 46. By so doing, hydraulic pressure from the oil pump 46 is supplied to the hydraulic chamber 25 of the first actuator $20_1$ and the hydraulic chamber 37 of the first driving means $39_1$ via the first oil passage $44_1$, and as shown in FIG. 12, in the first actuator $20_1$ the operating plunger 23 applies a force, due to the hydraulic pressure of the hydraulic chamber 25, that rotates the first movable raising member $14_1$ to the raised position B via the pressure-bearing pin $14_1a$ of the first raising means $R_1$. In the first driving means $39_1$, the hydraulic piston 38 pushes the short arm $32_1b$ of the first latching lever $32_1$ toward the inner peripheral face of the piston inner 5*a* due to the hydraulic pressure of the hydraulic chamber 37 while withdrawing the long arm $32_1a$ inside the piston inner 5*a*. As a result, the piston outer 5*b* is allowed to move to the medium compression ratio position M.

The piston outer 5*b* moves to the medium compression ratio position M upon receiving the following types of spontaneous external force. That is, when the piston outer 5*b* is drawn toward the combustion chamber 4*a* by virtue of the intake negative pressure during the engine intake stroke, when the piston outer 5*b* is left behind from the piston inner 5*a* by virtue of frictional resistance occurring between the piston rings 10*a* to 10*c* and the inner face of cylinder bore 2*a* during the downward stroke of the piston 5, or when the piston outer 5*b* attempts to become detached from the piston inner 5*a* by virtue of the inertial force of the piston outer 5*b* accompanying deceleration of the piston inner 5*a* during the second half of the upward stroke of the piston 5, the piston outer 5*b* rises from the piston inner 5*a*, and when it reaches the medium compression ratio position M, the lower face of the third latching channel $31_3$ abuts against the long arm $32_2a$ of the second latching lever $32_2$, which has already been engaged with the third latching channel $31_3$, thereby preventing the piston outer 5*b* from ascending beyond the medium compression ratio position M. At the same time, since the position of the short arm $32_1b$ of the first latching lever $32_1$ and the position of the first latching channel $31_1$ are aligned, the short arm $32_1b$ of the first latching lever $32_1$, which is pushed toward the inner peripheral face of the piston inner 5*a* by the hydraulic piston 38 of the first driving means $39_1$, engages with the first latching channel $31_1$ and abuts against the upper face of the latching channel $31_1$. A dividing wall between the first and third latching channels $31_1$ and $31_3$ is therefore held from above and below between the short arm $32_1b$ of the first latching lever $32_1$ and the long arm $32_2a$ of the second latching lever $32_2$, thereby latching the piston outer 5*b* at the medium compression ratio position M.

In this way, the piston outer 5*b* is held at the medium compression ratio position M, and as shown in FIG. 20B as soon as the upwardly-facing cam $15_1a$ and the downwardly-facing cam $15_1b$ of the first cam mechanism $15_1$ are disengaged from each other, the first movable raising member $14_1$ is pivoted to the raised position B by the pushing force from the operating plunger 23 of the first actuator $20_1$. As a result, as shown in FIG. 20C, the peaks of the upwardly-facing cam $15_1a$ and the downwardly-facing cam $15_1b$ of the first cam mechanism $15_1$ abut against each other, thereby firmly holding the piston outer 5*b* at the medium compression ratio position M.

<Control for High Compression Ratio> (see FIG. 13 to FIG. 16, FIG. 19 and FIG. 20A to FIG. 20E)

Figure 16:
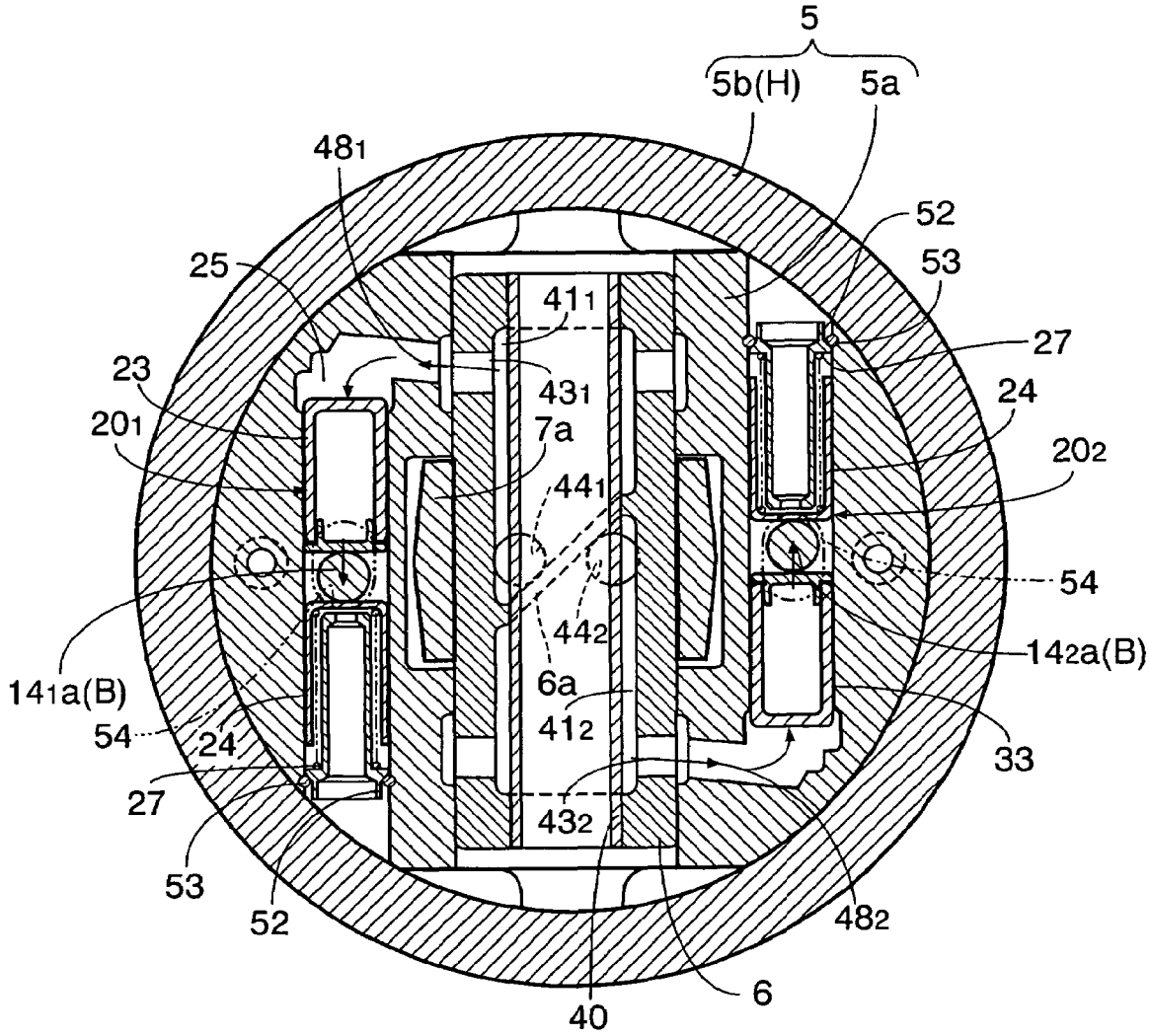
Figure 17:
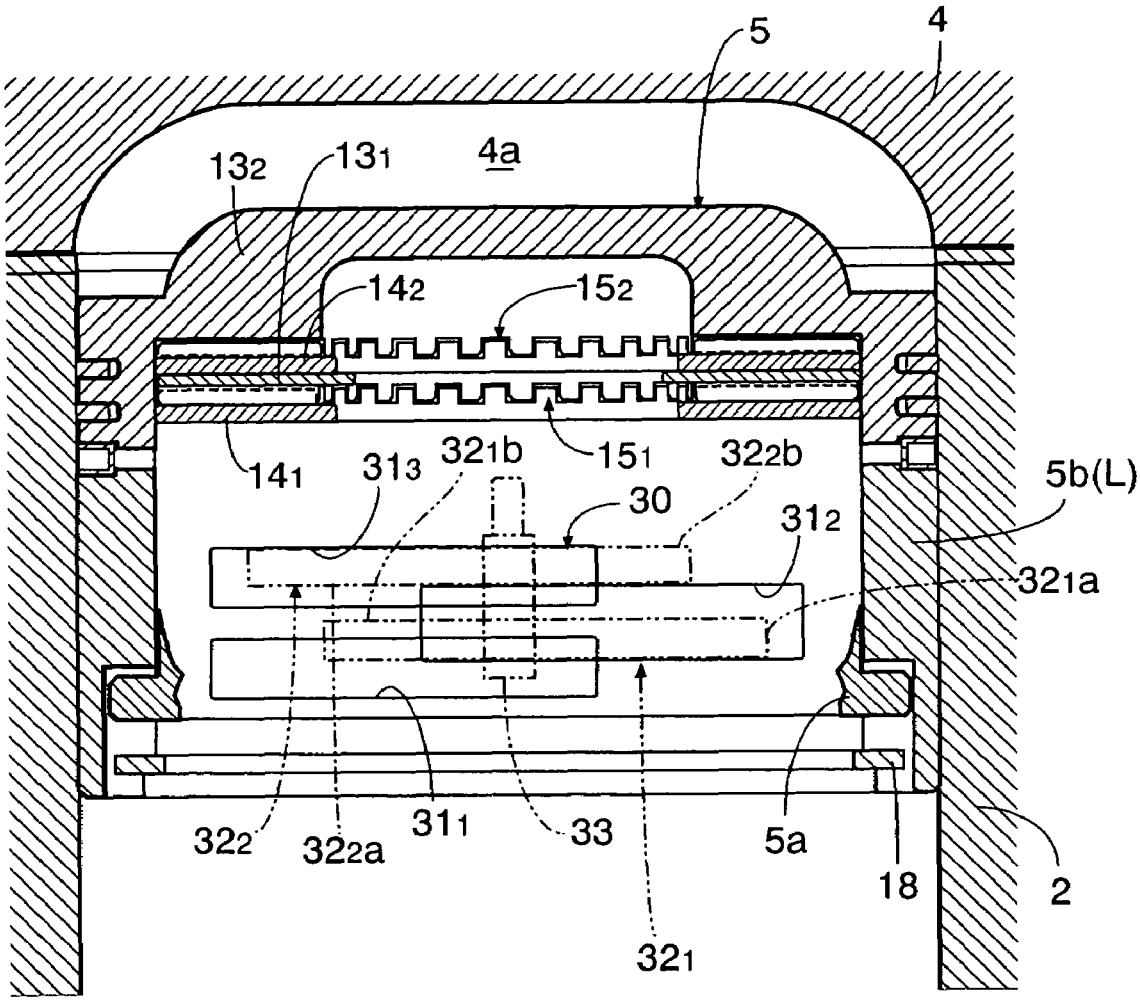
Figure 18:
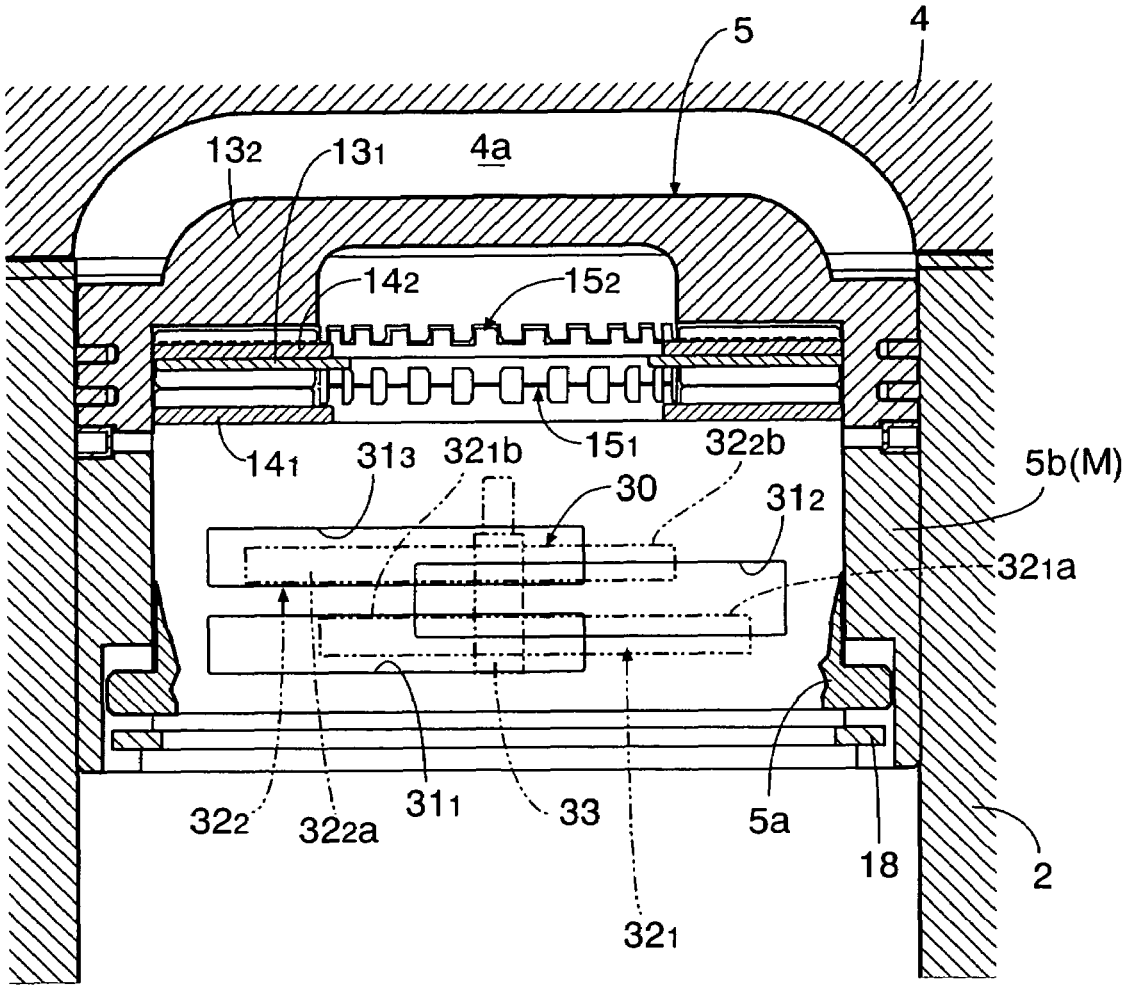

To obtain a high compression ratio state in order to further increase the compression ratio of the internal combustion engine E, the second solenoid switch valve $45_2$ is also energized while maintaining the energized state of the first solenoid switch valve $45_1$, thus connecting the second oil passage $44_2$ to the oil pump 46. By so doing, since hydraulic pressure from the oil pump 46 is also supplied to the hydraulic chamber 25 of the second actuator $20_2$ and the hydraulic chamber 37 of the second driving means $39_2$ via the second oil passage $44_2$, as shown in FIG. 16, in the second actuator $20_2$ also the operating plunger 23 applies a force, due to the hydraulic pressure of the hydraulic chamber 25, to rotate the second movable raising member $14_2$ to the raised position B via the pressure-bearing pin $14_1a$ of the second raising means $R_2$. In the first driving means $39_1$ also, the hydraulic piston 38 pushes the short arm $32_2b$ of the second latching lever $32_2$ by means of the hydraulic pressure of the hydraulic chamber 37 toward the inner peripheral face of the piston inner 5*a* while withdrawing the long arm $32_2a$ inside the piston inner 5*a*. As a result, the piston outer 5*b* is allowed to move to the high compression ratio position H.

When the piston outer 5*b* moves up to the high compression ratio position H as a result of receiving a spontaneous external force similar to those when the piston outer 5*b* moves to the medium compression ratio position M, the stopper ring 18 at the lower end part of the piston outer 5*b* abuts against the lower end face of the piston inner 5*a*, thereby stopping the ascent of the piston outer 5*b* at a predetermined high compression ratio position H. At the same time, since the position of the short arm $32_2b$ of the second latching lever $32_2$ and the position of the second latching channel $31_2$ are aligned, the short arm $32_2b$ engages with the second latching channel $31_2$ by virtue of the pushing force of the hydraulic piston 38 of the second driving means $39_2$, and abuts against the upper face of the latching channel $31_2$. Therefore, even when the piston outer 5*b* receives a kick due to impulsive contact of the stopper ring 18 against the lower end face of the piston inner 5*a*, since the kick is borne by the short arm $32_2b$ of the second latching lever $32_2$, the piston outer 5*b* can be prevented from bouncing back from the high compression ratio position H and can be held reliably at the high compression ratio position H.

In this way, the piston outer 5*b* reaches the high compression ratio position H and, as shown in FIG. 20D, as soon as the upwardly-facing cam $15_2a$ and the downwardly-facing cam $15_2b$ of the second cam mechanism $15_2$ are disengaged from each other, the second movable raising member $14_2$ is also pivoted to the raised position B by virtue of the pushing force of the operating plunger 23 of the second actuator $20_2$. As a result, as shown in FIG. 20E the second cam mechanism $15_2$ makes the top faces of the peaks of the upwardly-facing cam $15_2a$ and the downwardly-facing cam $15_2b$ abut against each other in the same manner as in the first cam mechanism $15_1$, thus firmly holding the piston outer 5*b* at the high compression ratio position H.

In this way, there is no play in the axial direction in the first and second cam mechanisms $15_1$ and $15_2$, and the piston inner and outer 5*a* and 5*b* move up and down within the cylinder bore 2*a* as a unit while maximizing the compression ratio.

As hereinbefore described, by pivoting the first and second movable raising members $14_1$ and $14_2$ between just two positions, that is, the non-raised position A and the raised position B, it is possible to switch the position of the piston outer 5*b* appropriately between the three stages, that is, the low compression ratio position L, the medium compression ratio position M, and the high compression ratio position H, thereby enabling a close correspondence with various running conditions of the internal combustion engine E.

Moreover, when the piston outer 5*b* is controlled at the low compression ratio position L, the medium compression ratio position M, or the high compression ratio position H, since rotation thereof relative to the piston inner 5*a* is restricted by the spline teeth 11*a* and the spline grooves 11*b* formed on the mating faces of the piston inner 5*a* and the piston outer 5*b* and slidably engaging with each other, it is possible to make the shape of the top face of the piston outer 5*b*, which faces the combustion chamber 4*a*, match the shape of the combustion chamber 4*a*, thus enabling the compression ratio at the high compression ratio position H of the piston outer 5*b* to be increased effectively.

Moreover, when the piston outer 5*b* is at the medium compression ratio position M or the high compression ratio position H, since a large thrust that the piston outer 5*b* receives from the combustion chamber 4*a* during the engine expansion stroke acts perpendicularly on the flat top face of the peaks of the upwardly-facing cams $15_1a$ and $15_2a$ and the downwardly-facing cams $15_1b$ and $15_2b$ of the first cam mechanism $15_1$ and/or the second cam mechanism $15_2$, the flat top faces abutting against each other, the first movable raising member $14_1$ and/or the second movable raising member $14_2$ are not pivoted by the thrust. As a consequence, the hydraulic pressure supplied to the hydraulic chambers 25 of the first and second actuators $20_1$ and $20_2$ does not need to have such a high pressure as to be able to counterbalance the thrust and, furthermore, even when there are some bubbles in the hydraulic chambers 25, since the piston outer 5*b* can be held stably at the medium compression ratio position M and the high compression ratio position H, there are no problems.

Moreover, since movement of the piston outer 5*b* between the low compression ratio position L, the medium compression ratio position M, and the high compression ratio position H utilizes a spontaneous external force, which acts on the piston inner and outer 5*a* and 5*b* during reciprocation of the piston 5 so as to make the piston inner and outer 5*a* and 5*b* move toward or away from each other in the axial direction, the first and second actuators $20_1$ and $20_2$ are required only to exhibit an output for simply pivoting the first and second movable raising members $14_1$ and $14_2$ between the non-raised position A and the raised position B, thereby enabling the capacity and dimensions of the first and second actuators $\mathbf{20}_1$ and $\mathbf{20}_2$ to be reduced.

Among the above-mentioned spontaneous external forces, the frictional resistance between the piston rings 10*a* to 10*c* and the inner face of the cylinder bore 2*a* and the inertial force of the piston outer 5*b* are particularly effective. Since the above-mentioned frictional resistance changes relatively little in response to a change in rotational speed of the engine whereas the inertial force of the piston outer 5*b* increases in response to an increase in the rotational speed of the engine in the manner of a quadratic curve, for switching the position of the piston outer 5*b* the frictional resistance is dominant in a low rotational speed region of the engine, and the inertial force of the piston outer 5*b* is dominant in a high rotational speed region of the engine.

Furthermore, since the hydraulic chamber 25 of the first actuator $\mathbf{20}_1$ and the hydraulic chamber 37 of the first driving means $\mathbf{39}_1$ are connected switchably to the oil pump 46 and the oil reservoir 47 via the common first solenoid switch valve $\mathbf{45}_1$, and the hydraulic chamber 25 of the second actuator $\mathbf{20}_2$ and the hydraulic chamber 37 of the second driving means $\mathbf{39}_2$ are connected switchably to the oil pump 46 and the oil reservoir 47 via the common second solenoid switch valve $\mathbf{45}_2$, the two actuators $\mathbf{20}_1$ and $\mathbf{20}_2$ and the two driving means $\mathbf{39}_1$ and $\mathbf{39}_2$ can be operated efficiently with common hydraulic pressure, the hydraulic pressure circuit can be simplified, and the variable compression ratio system can be provided at low cost.

Furthermore, since the operating plunger 23 and the return plunger 24, which are components of each of the first and second actuators $\mathbf{20}_1$ and $\mathbf{20}_2$, are fitted in the common cylinder hole 21 formed in the piston inner 5*a*, the structure is simple, and machining of the holes is easy, thus contributing to a reduction in cost.

Moreover, since each of the cylinder holes 21 of the first and second actuators $\mathbf{20}_1$ and $\mathbf{20}_2$ is formed in the piston inner 5*a* in parallel to the piston pin 6, which is disposed therebetween, the first and second actuators $\mathbf{20}_1$ and $\mathbf{20}_2$ can be arranged in the confined interior of the piston inner 5*a* without interfering with the piston pin 6.

Furthermore, since the axes of the operating and return plungers 23 and 24 of the first and second actuators $\mathbf{20}_1$ and $\mathbf{20}_2$ are arranged so as to be substantially orthogonal to a pivot 19 radius that intersects the axis of the corresponding pressure-bearing pins $\mathbf{14}_1a$ and $\mathbf{14}_2a$, the pushing forces of the operating and return plungers 23 and 24 can be transmitted efficiently to the first and second raising members $\mathbf{14}_1$ and $\mathbf{14}_2$ via the pressure-bearing pins $\mathbf{14}_1a$ and $\mathbf{14}_2a$, thus contributing to making the actuators $\mathbf{20}_1$ and $\mathbf{20}_2$ compact.

Moreover, since end faces of the operating and return plungers 23 and 24 are in line contact with a cylindrical outer peripheral face of the pressure-bearing pins $\mathbf{14}_1a$ and $\mathbf{14}_2a$, the contact area is relatively large, thus decreasing the plane pressure and contributing to an improvement in the durability.

A second embodiment of the present invention is now explained with reference to FIG. 22A to FIG. 22E.

The second embodiment has the same arrangement as that of the preceding embodiment except that one side face of each peak of first and second cam mechanisms $\mathbf{15}_1$ and $\mathbf{15}_2$ is provided with inclined faces 58*a*, 58*b*; 59*a*, 59*b* which slide away from each other in the axial direction when first and second movable raising members $\mathbf{14}_1$ and $\mathbf{14}_2$ pivot from a non-raised position A to a raised position B, and in FIG. 21 parts corresponding to the parts of the preceding embodiment are denoted by the same reference numerals and symbols, thereby avoiding duplication of the explanation.

In the second embodiment, since one side of each peak of the first and second cam mechanisms $\mathbf{15}_1$ and $\mathbf{15}_2$ is the inclined face 58*a*, 58*b*; 59*a*, 59*b*, compared with the preceding embodiment the pitch of the peaks is widened, the operating stroke angle of the first and second raising members $\mathbf{14}_1$ and $\mathbf{14}_2$ increases, and the area of the top face of each of the peaks decreases, but even when the spontaneous external force for moving the piston outer 5*b* to a medium compression ratio position M or a high compression ratio position H is weak, if a pivoting force is applied to the first and second raising members $\mathbf{14}_1$ and $\mathbf{14}_2$ by means of first and second actuators, which are not illustrated, the mutual lifting action of the inclined faces 58*a*, 58*b*; 59*a*, 59*b* enables the piston outer 5*b* to be pushed up to the medium compression ratio position M or the high compression ratio position H.

The present invention is not limited to the above-mentioned embodiments, and can be modified in a variety of ways without departing from the spirit and scope of the present invention. For example, by changing the height of the peaks of the first and second cam mechanisms $\mathbf{15}_1$ and $\mathbf{15}_2$, a mode in which the first movable raising member $\mathbf{14}_1$ is held at the non-raised position A and the second movable raising member $\mathbf{14}_2$ is pivoted to the raised position B is added, thereby enabling the piston outer 5*b* to be controlled at four stages, that is, a low compression ratio position, a first medium compression ratio position, a second medium compression ratio position, and a high compression ratio position. Furthermore, the operating mode of the first and second solenoid switch valves $\mathbf{45}_1$ and $\mathbf{45}_2$ can be the opposite of that of the above-mentioned embodiments. That is, an arrangement is possible in which, when the switch valves $\mathbf{45}_1$ and $\mathbf{45}_2$ are in a nonenergized state, the first and second oil passages $\mathbf{44}_1$ and $\mathbf{44}_2$ are connected to the oil pump 46, and when they are in an energized state, the oil passages $\mathbf{44}_1$ and $\mathbf{44}_2$ are connected to the oil reservoir 47.

Furthermore, if the set load for the return spring 27 of the first actuator $\mathbf{20}_1$ is set to be lower than the set load for the return spring 27 of the second actuator $\mathbf{20}_2$, the set load for the operating spring 34 of the first driving means $\mathbf{39}_1$ is set to be lower than the set load for the operating spring 34 of the second driving means $\mathbf{39}_2$, the first and second oil passages $\mathbf{44}_1$ and $\mathbf{44}_2$ are combined into a common single oil passage, this common single oil passage is provided with a common single switch valve, and hydraulic pressure control means is also provided that can control the hydraulic pressure of the oil passage at a first hydraulic pressure at which the first actuator $\mathbf{20}_1$ and the first driving means $\mathbf{39}_1$ can be operated hydraulically and a second hydraulic pressure at which the second actuator $\mathbf{20}_2$ and the second driving means $\mathbf{39}_2$ can be operated hydraulically, it is thereby possible to carry out operation of the first and second actuators $\mathbf{20}_1$ and $\mathbf{20}_2$ in sequence and operation of the first and second driving means $\mathbf{39}_1$ and $\mathbf{39}_2$ in sequence by means of a simple hydraulic pressure circuit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An internal combustion engine variable compression ratio system comprising:

a piston inner connected to a connecting rod via a piston pin;

a piston outer that, while being fitted around the outer periphery of the piston inner so that the piston outer can slide only in the in an axial direction and having an outer end face facing a combustion chamber, is capable of moving to a low compression ratio position (L) close to the piston inner, a high compression ratio position (H) close to the combustion chamber, and at least one medium compression ratio position (M) between the low compression ratio position (L) and the high compression ratio position (H); and at least two sets of raising means disposed in line in the axial direction between an upper face of the piston inner and a lower face of the piston outer opposed to the upper face of the piston inner, each set of raising means comprising a movable raising member, the movable raising members being individually capable of pivoting in a peripheral direction between a non-raised position (A) and a raised position (B) around the axis of the piston inner and outer, the piston outer being held at the low compression ratio position (L) when two of the movable raising members are pivoted to the non-raised position (A), the piston outer being held at the medium compression ratio position (M) when only one of the movable raising members is pivoted to the raised position (B), the piston outer being held at the high compression ratio position (H) when two of the movable raising members are pivoted to the raised position (B), and each of the raising means further comprising a member opposed to the respective movable raising member and capable of changing a position in abutment against the movable raising member in the axial direction of the piston inner and piston outer.

2. The internal combustion engine variable compression ratio system according to claim 1, wherein the at least two sets of raising means include first raising means and second raising means.

3. The internal combustion engine variable compression ratio system according to claim 2, wherein the movable raising members of the first and second raising means include, respectively, an annular first movable raising member and an annular second movable raising member.

4. The internal combustion engine variable compression ratio system according to claim 3, wherein the first raising means is formed from the annular first movable raising member pivotably fitted around a pivot portion formed coaxially and integrally on an upper face of the piston inner, and an annular first fixed raising member axially and slidably spline-coupled to a cylindrical pivot secured coaxially to an upper end face of the pivot portion.

5. The internal combustion engine variable compression ratio system according to claim 4, wherein the annular first movable raising member is capable of reciprocatingly pivoting between the non-raised position (A) and the raised position (B) set around the pivot portion on the upper face of the piston inner, and a first cam mechanism that allows the annular first fixed raising member to move up and down along the cylindrical pivot accompanying the reciprocating pivoting is provided between the annular first movable raising member and the annular first fixed raising member.

6. The internal combustion engine variable compression ratio system according to claim 3, wherein the second raising means includes the annular second movable raising member pivotably and axially slidably fitted around a pivot portion on a flat upper face of an annular second fixed raising member.

7. The internal combustion engine variable compression ratio system according to claim 6, wherein the annular second movable raising member is capable of reciprocatingly pivoting between the non-raised position (A) and the raised position (B) set around a cylindrical pivot on the upper face of the annular second fixed raising member, and a second cam mechanism allows the piston outer to move up and down accompanying the reciprocating pivoting is provided between the second movable raising member and the piston outer.

8. The internal combustion engine variable compression ratio system according to claim 1, further comprising a plurality of piston rings fitted around an outer periphery of the piston outer, the plurality of piston rings being in intimate sliding contact with an inner peripheral face of a cylinder bore.

9. The internal combustion engine variable compression ratio system according to claim 1, wherein a top wall of the piston outer is arranged in a rectangular wave shape in a peripheral direction.

10. The internal combustion engine variable compression ratio system according to claim 6, wherein the annular second fixed raising member also serves as a top wall of the piston outer.

11. An internal combustion engine variable compression ratio system comprising:

a piston inner connected to a connecting rod via a piston pin;

a piston outer that, while being fitted around the outer periphery of the piston inner so that the piston outer can slide only in the axial direction and having an outer end face facing a combustion chamber, is capable of moving to a low compression ratio position (L) close to the piston inner, a high compression ratio position (H) close to the combustion chamber, and at least one medium compression ratio position (M) between the low compression ratio position (L) and the high compression ratio position (H); and at least two sets of raising means disposed in line in the axial direction between the piston inner and the piston outer, each set of raising means comprising a movable raising member, the movable raising members being individually capable of pivoting in a peripheral direction between a non-raised position (A) and a raised position (B) around the axis of the piston inner and outer, the piston outer being held at the low compression ratio position (L) when two of the movable raising members are pivoted to the non-raised position (A), the piston outer being held at the medium compression ratio position (M) when only one of the movable raising members is pivoted to the raised position (B), and the piston outer being held at the high compression ratio position (H) when two of the movable raising members are pivoted to the raised position (B).

12. The internal combustion engine variable compression ratio system according to claim 1, wherein the at least two sets of raising means include first raising means and second raising means.

13. The internal combustion engine variable compression ratio system according to claim 2, wherein the movable raising members of the first and second raising means include, respectively, an annular first movable raising member and an annular second movable raising member.

14. The internal combustion engine variable compression ratio system according to claim 3, wherein the first raising means is formed from the annular first movable raising member pivotably fitted around a pivot portion formed coaxially and integrally on an upper face of the piston inner, and an annular first fixed raising member axially and slidably spline-coupled to a cylindrical pivot secured coaxially to an upper end face of the pivot portion.

15. The internal combustion engine variable compression ratio system according to claim 4, wherein the annular first movable raising member is capable of reciprocatingly pivoting between the non-raised position (A) and the raised position (B) set around the pivot portion on the upper face of the piston inner, and a first cam mechanism that allows the annular first fixed raising member to move up and down along the cylindrical pivot accompanying the reciprocating pivoting is provided between the annular first movable raising member and the annular first fixed raising member.

16. The internal combustion engine variable compression ratio system according to claim 3, wherein the second raising means includes the annular second movable raising member pivotably and axially slidably fitted around a pivot portion on a flat upper face of an annular second fixed raising member.

17. The internal combustion engine variable compression ratio system according to claim 6, wherein the annular second movable raising member is capable of reciprocatingly pivoting between the non-raised position (A) and the raised position (B) set around a cylindrical pivot on the upper face of the annular second fixed raising member, and a second cam mechanism allows the piston outer to move up and down accompanying the reciprocating pivoting is provided between the second movable raising member and the piston outer.

18. The internal combustion engine variable compression ratio system according to claim 1, further comprising a plurality of piston rings fitted around an outer periphery of the piston outer, the plurality of piston rings being in intimate sliding contact with an inner peripheral face of a cylinder bore.

19. The internal combustion engine variable compression ratio system according to claim 1, wherein the top wall of the piston outer is arranged in a rectangular wave shape in a peripheral direction.

20. The internal combustion engine variable compression ratio system according to claim 6, wherein the annular second fixed raising member also serves as the top wall of the piston outer.

* * * * *